US007152283B2

(12) United States Patent
Murayama et al.

(10) Patent No.: US 7,152,283 B2
(45) Date of Patent: Dec. 26, 2006

(54) NOISELESS SURFACE FASTENER MEMBER, NOISELESS SURFACE FASTENER COMBINED WITH THE NOISELESS SURFACE FASTENER MEMBER AND PRODUCT ATTACHED WITH THE SAME NOISELESS SURFACE FASTENER MEMBER OR THE SAME NOISELESS SURFACE FASTENER

(75) Inventors: Teiichi Murayama, Toyama-ken (JP); Shintaro Ohsugi, Toyama-ken (JP); Akira Ishibashi, Toyama-ken (JP); Masashi Doi, Toyama-ken (JP); Mamoru Tanaka, Toyama-ken (JP); Yoshihiro Hashizume, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/254,594

(22) Filed: Oct. 20, 2005

(65) Prior Publication Data

US 2006/0032033 A1 Feb. 16, 2006

Related U.S. Application Data

(62) Division of application No. 10/442,523, filed on May 21, 2003, now abandoned.

(30) Foreign Application Priority Data

May 31, 2002 (JP) ..... 2002-159799
Nov. 26, 2002 (JP) ..... 2002-342769

(51) Int. Cl.
*A44B 18/00* (2006.01)

(52) U.S. Cl. ..... 24/442; 24/306; 428/100

(58) Field of Classification Search ..... 24/445, 24/444, 442, 306, 446, 447, 452; 428/100
See application file for complete search history.

(56) References Cited

U.S. PATENT DOCUMENTS

| | | | | |
|---|---|---|---|---|
| 4,247,586 | A | | 1/1981 | Rochlin |
| 4,776,068 | A | | 10/1988 | Smirlock et al. |
| 4,884,323 | A | * | 12/1989 | Provost et al. ..... 24/442 |
| 5,611,122 | A | | 3/1997 | Torigoe et al. |
| 5,659,930 | A | | 8/1997 | Okawa |
| 5,731,056 | A | | 3/1998 | Butler |
| 6,460,230 | B1 | | 10/2002 | Shimamura et al. |
| 6,463,635 | B1 | | 10/2002 | Murasaki |
| 6,572,727 | B1 | | 6/2003 | Schulte |
| 6,635,327 | B1 | | 10/2003 | Ohira et al. |

* cited by examiner

*Primary Examiner*—Jack W. Lavinder
(74) *Attorney, Agent, or Firm*—Everest Intellectual Property Law Group; Michael S. Leonard

(57) ABSTRACT

A surface fastener and a product attached with the same surface fastener, having a structure for reducing a sound generated upon separation of a surface fastener member itself and capable of reducing a sound generated upon separation of the product attached with the same surface fastener.

A sheet material is attached to a rear surface of a flat base material of a surface fastener member comprising an engaging-element-formation region having multiple engaging elements on a front surface of the flat base material and an engaging-element non-formation region having no engaging elements or comprising a sewing region and a non-sewing region. The sheet material has apparent density of 0.5 g/cm$^3$ or less at least in a region corresponding to the engaging-element-formation region or the non-sewing region as sound transmission restricting means, or has at least one through hole as the sound transmission restricting means. Further, the apparent density of the flat base material is set to 0.5 g/cm$^3$.

8 Claims, 16 Drawing Sheets

NOISELESS SURFACE FASTENER MEMBER, NOISELESS SURFACE FASTENER COMBINED WITH THE NOISELESS SURFACE FASTENER MEMBER AND PRODUCT ATTACHED WITH THE SAME NOISELESS SURFACE FASTENER MEMBER OR THE SAME NOISELESS SURFACE FASTENER

This application is a divisional of copending parent application Ser. No. 10/442,523 filed May 21, 2003 now abandoned which is incorporated by reference.

BACKGROUND OF THE INVENTION

1. Field of the Invention

The present invention relates to a surface fastener member, a surface fastener combined with the same surface fastener member and a product attached with the same surface fastener or the like and more particularly to a noiseless surface fastener member capable of reducing a noise generated when it is separated, a combination thereof and a product attached with the surface fastener capable of reducing the noise occurring when the same surface fastener is separated.

2. Description of the Prior Art

In a fiber surface fastener, bold fiber-like monofilaments or strings each composed of multiple narrow fiber-like filaments (multifilaments), both of which are made of synthetic resin, are woven or knitted into a base material obtained by weaving or knitting various kinds of fiber yarns so as to form loops on one side of the base material. The monofilament loops are partially cut out so as to form hook-shaped male engaging elements while the multifilament loops form female engaging elements just with that loop configuration. The male engaging element and the female engaging element engage each other when pressure is applied and if a force is applied to both elements in a separation direction, the engagement is released so that they are separated from each other. In a molded surface fastener of synthetic resin as well as the fiber surface fastener having such a structure, a noise offensive to the ear is generated when the male and female engaging elements are disengaged.

Conventionally, a number of fiber surface fasteners aiming at suppressing such noise have been proposed. Examples disclosing relating noiseless structures are, for example, U.S. Pat. Nos. 4,776,068 and 4,884,323.

In the sound deadening structure of the fiber surface fastener disclosed in the U.S. Pat. No. 4,776,068, the surface fastener member, which is a surface fastener component, has means for reducing a complex of noise and vibration given by the planar base material thereof to surrounding space. This means reduces a noise generated when the surface fastener member is quickly separated from a mating joint face. This means comprise forming the base material with a larger volume than the engaging face, joining a planar large-volume auxiliary base material to the base material, incorporating flexible large-volume material in the base material, forming the base material and the engaging face separately while connecting these components at multiple points, employing a grid structure for the base material in order to lower a transmission capacity of vibration in surrounding spaces.

More specifically, a grid structure having a porosity of 50% or more, which indicates a low transmission capacity for vibration in a space surrounding the base material, is employed so as to reduce a complex of noise and vibration generated when the surface fastener members are separated from each other. Further, in such a surface fastener, the sound level measured at a position apart by 1 feet from that separation area needs to be a specified value or less. Alternatively, engaging faces of each planar base material are provided separately in an extending manner and a layer having an air density is formed on the rear face of the base material so as to increase its volume. Consequently, the level of sound pressure generated when the surface fastener is separated can be reduced sufficiently to 4.2 dB or less.

Meanwhile, according to U.S. Pat. No. 4,884,323, in a product attached with the surface fastener member, a flat base material having the engaging elements on a face thereof is attached such that the rear surface thereof is apart from the product. Consequently, the noise-generation energy transmitted from the base material to the product when the engaging surface fastener members are separated is reduced, so that the noise generated from the product can be reduced. Alternatively, a large-volume material is attached to the rear surface of the product, and even if noise energy is transmitted to a member, the energy is damped by the large-volume material attached to the rear surface of the product. That is, according to the surface fastener attaching system of U.S. Pat. No. 4,884,323, an intermediate member is interposed between the base material and the product or large-volume member with a low density is attached to the rear surface of the product to be attached to the base material. When the intermediate member is used, it is attached to the base material and the product by coupling their edge portions. A grid-like base material having the same structure as above-mentioned U.S. Pat. No. 4,776,068 can be adopted as the base material.

In the noiseless surface fastener disclosed in U.S. Pat. No. 4,776,068, both of the base materials of the surface fastener members to be joined together need to be in a grid-like form, though, in this kind of the surface fastener used in various fields, its mating components need to be in various forms. For example, when a grid-like base material is used, engaging elements which constitute an engagement face formed on one face of the base material are arranged also in a grid-like form, so that the engagement ratio and engagement strength necessarily drop. Moreover, when the base material is in a grid-like structure, not only the strength the base material is diminished but also a high sewing accuracy is required.

In the attachment system for the surface fastener member according to U.S. Pat. No. 4,884,323, because the surface fastener member is attached only at their edge portions. In addition, there is no element for fixing the surface fastener member to the cloth at the central portion of the surface fastener member. Therefore, this system is not suitable for attachment of a wide surface fastener. Further, interposing a large-volume material between the base material of the surface fastener member and the cloth results in such a disadvantage that the sewing method becomes complicated thereby increasing the number of production steps. In order to obtain enough effects with this method, the capacity of vibration absorption agent needs to be increased sufficiently. As a consequence, a fastener attachment portion of the product needs to be thick.

In the meantime, Japanese Patent Application Laid-Open No. 6-103 discloses a surface fastener having vibration absorption material on a rear surface of its base material. In order to obtain a sufficient performance with this method, the vibration absorption agent needs to be heavy enough, thereby causing such a disadvantage that the surface fastener becomes thick. Moreover, although these technologies aim at suppressing the magnitude of a separation noise, some sounds are offensive to the ear, while the others are not. Therefore, just reducing the sound level is not sufficient, and it is important not to generate sounds which are offensive to the ear.

A relatively large abnormal sound generated upon separation of the surface fastener occurs when the base material is vibrated. The sound damping structure disclosed in the aforementioned publication aims at reducing the vibration area of the base material so as to reduce vibration itself transmitted from the base material to the air. In this structure, when the surface fastener is attached to a product, the vibration is transmitted directly to the product, and complex vibration due to the vibration of the product itself is transmitted to the air, thereby generating a large noise. Consequently, sufficient effects cannot be obtained. Further, if an intermediate member or vibration absorption member is provided separately on the rear surface, sewing or bonding labor doubles, thereby increasing the cost.

The above-mentioned publication of the prior art aims at reducing the noise generated with a method of reducing the ratio of the base material vibration transmitted to the air. However, when the surface fastener is attached on an attachment object, the vibration of the surface fastener base material is transmitted to the attachment object, accompanying radiation of the sound from the attachment object. Thus, sufficient sound-damping effects cannot be obtained. Also, when a mounting member or vibration absorption material is provided on the rear surface of the surface fastener, its entire structure becomes thick, and if this fastener is employed for clothing, it becomes bulky and the texture of the clothing is deteriorated.

Furthermore, when the surface fastener member is attached by sewing, the vibration upon separation is transmitted to the object attached with the surface fastener, and noise is generated also from the attachment object. Therefore, the sound damping effect is not achieved sometimes even if the noise generated from the surface fastener itself is reduced.

SUMMARY OF THE INVENTION

The present invention has been achieved to solve these problems. A principal object of the invention is to develop a structure of a surface fastener for reducing a sound generated upon separation of the surface fastener, to reduce the sound generated upon separation of a product attached with the same surface fastener and to develop a product attached with a surface fastener in which the product itself can reduce the sound generated even when the surface fastener is an ordinary one. Another object of the present invention is to provide a surface fastener which achieves uniform engagement between male and female engaging elements through an entire engagement face, secures a required engagement strength, has no special restrictions about a product to be attached to and effectively suppresses generation of an abnormal sound upon separation, and to provide various products attached with the same surface fastener.

The present invention relates to a noiseless surface fastener constituted of a combination of surface fastener members which engage each other, and the sound generated upon separation of the surface fastener is reduced by specifying an attaching structure for the surface fastener member. Further, the present invention relates to a product attached with the surface fastener in which the sound generated upon separation is reduced by selecting a structure of an object to be attached with the surface fastener member without using a conventional attaching member or vibration absorption material.

U.S. Pat. No. 4,776,068 mentioned above aims at reducing a noise by constructing the surface fastener base material in a lattice structure so as to reduce efficiency of vibration transmission to the air and attaching material having mass to a rear surface of the base material. Meanwhile, in U.S. Pat. No. 4,884,323, a mounting system is provided on a rear surface of the surface fastener base material so as to separate the surface fastener attachment object from the surface fastener base material through the mounting system, thereby preventing vibration from being transmitted from the base material to the surface fastener attachment object.

It has been understood from an experiment by the inventors that the abnormal sound from the surface fastener is generated when the base materials of the engaging surface fasteners are pulled strongly by hooks and loops, and, after the engagement is released, the pulled base materials are restored to their original condition instantaneously. It is considered that, at this time, vibration is transmitted in the air as in a speaker cone and propagated as a sound. The lattice-like structure disclosed in U.S. Pat. No. 4,776,068 corresponds to drilling holes in the speaker cone, which suppresses transmission efficiency of vibration into the air.

According to a noiseless surface fastener member of the present invention, there is provided a surface fastener member provided on a front surface of a flat base material thereof with an engaging-element-formation region having multiple engaging elements and an engaging-element non-formation region having no engaging elements, wherein a sheet material is attached to a rear surface of the flat base material, and the sheet material has sound transmission restricting means at least in a region corresponding to the engaging-element-formation region.

If considering the present invention from another viewpoint, the sheet material is sewed to the rear surface of the flat base material and a sewing region and a non-sewing region located inside the sewing region are formed on the surface fastener member. The sheet material has sound transmission restricting means at least in a region corresponding to the non-sewing region.

The noiseless surface fastener member of the present invention includes cases where the flat base material is composed of synthetic resin as well as fiber-made structural material such as a woven, knitted or unwoven fabric and lace. If the flat base material is a woven or knitted fabric, hook-like pieces, which are multiple male engaging elements erected from the flat base material, are formed in a hook-like or mushroom-like shape by weaving or knitting monofilaments in a loop shape at the same time when the flat base material is woven or knitted and by cutting or melting part of loops. As for multiple piles which are female engaging elements, multifilaments are woven or knitted in a pile shape at the same time when the flat base material is woven or knitted, and then piles of single fibers directed in multiple directions are formed by buffing or the like.

When the flat base material is an unwoven fabric, the monofilaments are implanted into the unwoven fabric in a loop shape, and a part of each loop is cut or melted so as to form a hook-like or mushroom-like piece. Alternatively, back-coating or resin treatment is carried out while multiple piles formed on the surface of the unwoven fabric are maintained in their original configuration, so that the pile pieces which are female engaging elements are formed by heat setting. When a synthetic-resin flat base material is used, multiple hook-like pieces are molded integrally on a surface of the base material at the same time when it is molded so as to make a male surface fastener member.

A prominent feature of the present invention is that the sheet material attached on the rear surface of the flat base material of the surface fastener member has sound transmission restricting means provided in a region corresponding to the engaging-element-formation region or the non-sewing region of the base material. In addition, transmission of sound generated upon separation of the engaging elements of the surface fasteners is suppressed with the sound transmission restricting means of the sheet material so as to reduce a sound generated from the surface fastener itself including the sheet material. Not only fiber-made sheet material such as a woven, knitted or unwoven fabric and lace but also synthetic-resin sheet material such as polyester, polyethylene and nylon can be used as the sheet material.

The sound transmission restricting means includes setting the apparent density of at least a region corresponding to the engaging-element-formation region or the non-sewing region of the sheet material to 0.5 g/cm$^3$ or less. In a weaving or knitting structure, the apparent density can be controlled by adjusting warp and weft density or knitting pattern gauge, or designing various kinds of lace patterns. Further, the apparent density can be also controlled by using one or more crimp fibers/yarns or bulky fibers/yarns as component fibers or yarns of the fiber structural material. When the sheet material density is lowered so as to suppress vibration transmission, a vibrating area of the sheet material is reduced and consequently, transmission efficiency of the vibration to the air is dropped. That is, this is the same as suppressing the transmission efficiency of the vibration into the air by reducing the size of the speaker cone.

Further, it is also effective to employ a largely curved structure as the sound transmission restricting means without linearly forming the composition yarns of the woven or knitted fabric. The sound transmission restricting means can be at least one through hole which penetrates front and rear surfaces and is formed at least in a region corresponding to the engaging-element-formation region or the non-sewing region of the sheet material. The through hole in this case may be a through hole produced by the weaving or knitting structure or a through hole formed by dissolving and removing required composition yarns as in chemical lace or a through hole formed positively by punching.

In the product attached with the surface fastener, in which the surface fastener attachment object is attached on the rear surface of the sheet material having the sound transmission restricting means, the separation sound can be reduced largely. This is because the sound transmission restricting means of this product can suppress to a lower level the efficiency of transmitting vibration generated upon separation of the surface fastener. When the sheet material or the surface fastener attachment object is sewed integrally on the engaging-element non-formation region or the sewing region, vibration is transmitted through sewing yarns, so that the vibration is further damped upon transmission to the attachment object, thereby achieving quietness.

However, although the sound generated from the surface fastener itself can be reduced with such a method, when the surface fastener is sewed to cloth, for example, vibration is still transmitted to the surface fastener attachment object and a sound is generated also from the attachment object. Consequently, sufficient effect cannot be achieved. According to the present invention, a gap portion is provided on the surface fastener attachment object at a portion corresponding to the engagement-element-formation region or the non-sewing region located inside the sewing region, so as to restrict the vibration transmitted to the cloth thereby reducing the sound generated. The surface fastener attachment object mentioned here includes a natural or artificial leather product and a synthetic resin sheet as well as fiber cloth such as ordinary woven, knitted or unwoven fabric and various kinds of lace.

Preferably, in the present invention, the product attached with the surface fastener contains the surface fastener attachment object having the sound transmission restricting means, which is provided on the rear surface of a base material of the surface fastener member having on the front surface of the flat base material thereof the engaging-element-formation region having multiple engaging elements and the engaging element non-formation region, such that the sound transmission restricting means is located at least in a region corresponding to the engaging-element-formation region.

When considering from another viewpoint, the surface fastener attachment object is sewed directly on the rear surface of the base material of the surface fastener member having multiple engaging elements on the front surface of the flat base material, and the sewing region and the non-sewing region located inside the sewing region are formed on the surface fastener member. Preferably, the sheet material of the product attached with the surface fastener has the sound transmission restricting means at least in a region corresponding to the non-sewing region.

More preferably, a backing fabric is attached to the rear surface of the surface fastener attachment object. Namely, according to the present invention, the sound transmission restricting means is provided at a surface fastener attaching portion of the surface fastener attachment object. In addition, the engaging-element-formation region of the male or female surface fastener member is disposed on the sound transmission restricting means and then, the surface fastener member is attached directly to the surface fastener attachment object. Accordingly, the surface fastener itself does not have to be provided with any sound damping function. Of course, the surface fastener itself can be provided with the above-described sound damping function.

As in the sound transmission restricting means of the sheet material attached on the rear surface of the surface fastener, the sound transmission restricting means described above is obtained by setting the apparent density of at least a region corresponding to the engaging-element-formation region or the non-sewing region of the surface fastener attachment object to 0.5 g/cm$^3$ or less, or providing with at least one through hole which is formed at least in a region corresponding to the engaging-element-formation region or the non-sewing region of the surface fastener attachment object and which penetrates the front and rear surfaces. In addition, the surface fastener attachment object consists of a weaving or knitting structure, and component yarns of the weaving or knitting structure are sometimes curved at 90° or more instead of being made linearly.

The vibration can be classified into a transverse wave and a longitudinal wave. The transverse wave is vibration perpendicular to the longitudinal direction of a yarn. This vibration is damped easily by a friction with surrounding yarns and back-coating agent. Also, if any vibration damping material or the like is provided, the sound is damped more effectively. On the other hand, the longitudinal wave is a wave vibrating in the longitudinal direction of the yarn. The propagation velocity of this wave is determined by storage modulus and the damping of this wave is determined by loss modulus. Usually, the ratio between storage modulus and loss modulus is about 10:1 and the damping is not so large under room temperature. Bending the yarn is an effective method for damping the longitudinal wave. Part of longitudinal wave energy is converted to the transverse wave by the bending the yarn and the longitudinal wave is damped rapidly each time it passes a bent part. The bending angle is preferred to be 90° or more in order to increase the damping effect.

If the yarn curvature is small as in a plain-woven fabric, the vibration is scattered to a wide range without being damped. On the other hand, in a structure in which multiple yarns are curved as in a knitting structure, the vibration is damped, so that the vibration stays in a narrow range. Particularly, if the yarns are bulky, the vibration damping effect is remarkable. This effect is particularly large if the apparent density of the weaving or knitting structure is 0.5 g/cm$^3$ or less. Further, crimp yarns can be used in order to adjust the bulk and reduce the density. The crimp yarn itself has bulk, so that the woven or knitted fabric becomes bulky and its density is lowered.

The ratio between storage modulus and loss modulus of a yarn can be improved by mixed fiber spinning. Particularly, if a yarn of material having a tan-delta peak near room temperature such as urethane fiber is mixed, the loss modulus of the yarn increases remarkably. Material whose glass transition temperature is low and whose crystallization degree is small, such as low-density polyethylene (LDPE) is also effective. If the loss modulus is increased as described above, a range in which vibration propagates becomes narrow thereby reducing the size of a speaker cone. Further, if the base material of the surface fastener is formed in a lace-like structure, yarns transmitting vibration is bent at multiple points, the number of yarns for transmitting the vibration is decreased, and the apparent density drops. Consequently, the quietness of the surface fastener can be achieved, which is more effective.

According to the present invention, especially when the surface fastener is made of fibers, the abnormal sound generated upon separation is suppressed by minimizing a vibrating area of the base material as much as possible and controlling the characteristic of vibration propagated from the surface fastener member to an attachment object such as cloth.

That is, the basic structure of the noiseless fiber fastener member of the present invention is the surface fastener member containing a joining face having multiple fiber engaging elements on any one of front and rear surfaces of the flat base material composed of fiber structural material. The apparent density of the base material of each of the mating fiber surface fastener members is 0.5 g/cm$^3$ or less. Meanwhile, at least the planar base material of the surface fastener member has a substantially uniform fiber density in its entire surface. The flat base material having the substantially uniform fiber density refers to various kinds of woven or knitted fabrics whose warp and weft density or course and wale density is uniform in their entire surfaces or to various kinds of unwoven fabrics whose fiber gap ratios are dispersed substantially uniformly.

According to the present invention, the base material of at least one surface fastener member can be composed of a multiple weaving or knitting structure which is woven or knitted in multiple layers through joining threads. In this case, a gap is formed between respective layers and those layers are joined with the joining threads. Furthermore, the apparent density of at least one layer including the base layer from which the engaging elements of the multiple weaving or knitting structure are erected is 0.5 g/cm$^3$ or less. Of course, the apparent density of the entire base material composed of the multiple weaving or knitting structure may be 0.5 g/cm$^3$ or less.

It has been understood from an experiment and analyses by the inventors that the abnormal sound from the surface fastener is generated when the base materials, where the male and female engaging elements are engaged, are pulled strongly by male engaging elements and female engaging elements, and, after the engagement is released, the pulled base materials are restored to their original condition instantaneously. It is considered that, at this time, vibration is transmitted in the air as in a speaker cone and propagated as a sound. The lattice-like structure disclosed in U.S. Pat. No. 4,776,068 corresponds to drilling holes in the speaker cone, which suppresses transmission efficiency of vibration into the air.

One of the sound damping principles of the present invention is to reduce the apparent density i.e., weight per specific volume, of the base material to reduce vibration area of the base material, i.e., to reduce the size of the speaker cone, so as to drop the vibration transmission to the air. As a specific means for reducing the vibration transmission efficiency of the base material, it is effective to form the yarns of the weaving or knitting structure in a curved structure instead of linear one. In addition, if the density of the base material is reduced, or particularly, if the apparent density is set to 0.5 g/cm$^3$ or less, the sound damping effect is considerable.

According to the present invention, in order to suppress the apparent density of the base material or part of layers of the base material to a low level, the weaving or knitting density of at least one surface fastener member is set low so as to disperse gaps uniformly on the entire surface of the base material, without forming both of the surface fastener members which join each other through their planes in the grid-like structure as in U.S. Pat. No. 4,776,068. Therefore, the base material has uniform fiber density on the substantially entire face thereof. As a result, even if the base material of one surface fastener member is formed in the grid-like structure, the configuration of the joining portion is stabilized when the surface fastener members are engaged with each other, because the base material of the other surface fastener member has a substantially uniform fiber density on its entire surface. Particularly, if the fiber density is substantially uniform on the entire surface of the base material, the engaging elements can be disposed uniformly on the entire engagement face of the surface fastener member. Thus, even if the base material of a mating surface fastener member is constructed in the grid-like structure, the engagement ratio with the mating engaging elements is increased, so that the engagement strength is necessarily increased. Of course, even in the base material having substantially uniform fiber density on the entire surface thereof, the engaging elements constituting the engagement face does not need to be dispersed uniformly, and a non-engagement plane can be formed by providing groups of engaging elements dispersedly.

When the fiber surface fastener member is of male surface fastener member, an engaging element consists of a male engaging element composed of a single bold-fiber-like monofilament of synthetic resin. When the base material is woven or knitted, the male engaging elements are formed by weaving or knitting monofilaments to form loops and then being subjected to heat setting or back-coating. Subsequently, male engaging elements having hook-like engaging head portion are formed by cutting part of the loops, or male engaging elements having mushroom-shaped engaging head portions are formed by melting top ends of the monofilaments erected after the cutting.

Meanwhile, when the fiber surface fastener member is the female surface fastener member, a fiber engaging element consists of a loop-like female engaging element composed of multifilaments of synthetic resin consisting of a group of a number of narrow fibers. Upon formation of the female engaging elements, when the base material is woven or knitted, the multifilaments are woven or knitted while forming the loops as in formation of the male engaging elements described above, and subsequently, buffing treatment is carried out so as to provide each of the loops made of single fibers with multi-directivity.

When the fiber surface fastener member is a male-and-female-mixed surface fastener member, the fiber engaging elements are composed of male engaging elements each formed of a monofilament of a single bold fiber of synthetic resin and female engaging elements each formed of a multifilament of multiple fine fibers of synthetic resin, and those male and female engaging elements are provided in a mixed manner. This male-and-female-mixed surface fastener member is manufactured in the same way as in formation of the above-described male and female engaging elements.

According to the present invention, no problem occurs even if the base material of one surface fastener member of the surface fastener has the grid-like structure while the base material of the other surface fastener member is in a non-grid structure. Both of the surface fastener members only need to satisfy the condition of the apparent density described above.

The vibration of the base material can be classified into a transverse wave and a longitudinal wave. The transverse wave is vibration perpendicular to the longitudinal direction of a yarn. This vibration is damped easily by a friction with surrounding yarns and back-coating agent. Also, if any vibration damping material or the like is provided, the sound is damped more effectively. On the other hand, the longitudinal wave is a wave vibrating in the longitudinal direction of the yarn. The propagation velocity of this wave is determined by storage modulus and the damping of this wave is determined by loss modulus. Usually, the ratio between storage modulus and loss modulus is about 10:1 and the damping is not so large under room temperature. Bending the yarn is an effective method for damping the longitudinal wave. Part of longitudinal wave energy is converted to the transverse wave by the bending the yarn and the longitudinal wave is damped rapidly each time it passes a bent part. The bending angle is preferred to be 90° or more in order to increase the damping effect.

If the yarn curvature is small as in a plain-woven fabric, the vibration is scattered in a wide range without being damped. On the other hand, in a structure in which multiple yarns are curved as in a knitting structure, the vibration is damped, so that the vibration stays in a narrow range. If the apparent density of the weaving or knitting structure is 0.5 $g/cm^3$ or less, the sound damping effect is remarkable in both of the plain-woven and knitting structures.

Particularly, the sound-damping effect is considerable when the bulky yarns are used. If the base material is made bulky using the bulky yarns or the crimp yarns, loss of acoustic vibration upon transmission is increased, and a range to which the sound is propagated is decreased, thereby suppressing generation of the sound. Also, by employing a yarn blended with fiber composed of material having a high viscous elasticity, particularly a large tan-delta, as the composition yarn of the base material, the sound transmitted through the base material is damped so that the vibration range becomes narrow, thereby suppressing generation of the sound.

When the base material of the fastener member has a knitting structure under the present invention, the wale density NW (wale count/cm) and the course density NC (course count/cm) preferably satisfy the relation of $5.9 \leqq NW+NC \leqq 29.0$. If the knitting structure of the base material is formed in multiple layers through joining threads, only at least one layer except the base layer having the engaging elements has to satisfy this relation. If the base material of the surface fastener member has the weaving structure, it is preferable that the warp density is 37.5 per cm or less, the weft density is 18.0 per cm or less and the size of the warp and weft yarns is 140 to 300 deniers. If the weaving structure of the base material is of multiple weaving structure, only at least one layer except the base layer having the engaging elements has to satisfy the above relation. The base material can be formed of lace fabric having the weaving or knitting structure.

As the base material of the surface fastener member of the present invention, an unwoven fabric structure can be mentioned as well as the ordinary weaving or knitting structure. In this case, the engaging elements are part of the composition fibers of the unwoven fabric and loop-like fibers projecting from the base material to the surface. In the meantime, the male engaging elements having a hook shape or the like can be formed using the unwoven fabric as the base material while using monofilaments as the engaging elements. That is, the monofilaments are implanted into the unwoven fabric so as to form monofilament loops from a face of the unwoven fabric, and the male engaging elements are formed through specific steps. Respective fibers of the unwoven fabric are curved largely at multiple points, increasing damping efficiency of vibration.

According to the present invention, gap forming means can be provided on the base material from which the engaging elements are erected or the rear surface of the base material in order to form a gap between the base material and the surface fastener attachment object. This gap forming means is constructed three-dimensionally by heating and pressurizing the base material itself or is constructed by projecting the loops or linear bodies from the rear surface of the base material. The three-dimensional structure or the loops and linear bodies can be molded, woven or knitted integrally at the same time when the base material is woven or knitted. Further, contact means for making point contact or linear contact between the base material and the attachment object are formed by, for example, forming fine protrusions made of synthetic resin integrally on the rear surface of the base material or by mixing fine beads into back-coating agent.

When the noiseless surface fastener having the above-described basic structure is attached to an attachment object, it is permissible to interpose vibration absorption means, which suppresses transmission of vibration, between the base material of the surface fastener and the object. As this vibration absorption means, for example, a fiber-made structure having a low apparent density such as unwoven fabric and bulky fabric having an excellent vibration absorption performance, foamed plastic materials or various rubber materials are available. The vibration absorption means may be manufactured separately and attached to the rear surface of the base material continuously after the surface fastener is produced or formed integrally with the object. The apparent density of the vibration absorption means at that time is preferably 0.5 $g/cm^3$ or less. If the apparent density of the object is 0.5 g/cm$^3$ or less, the level of the sound generated upon separation can be reduced.

DESCRIPTION OF THE PREFERRED EMBODIMENTS

Figure 1:
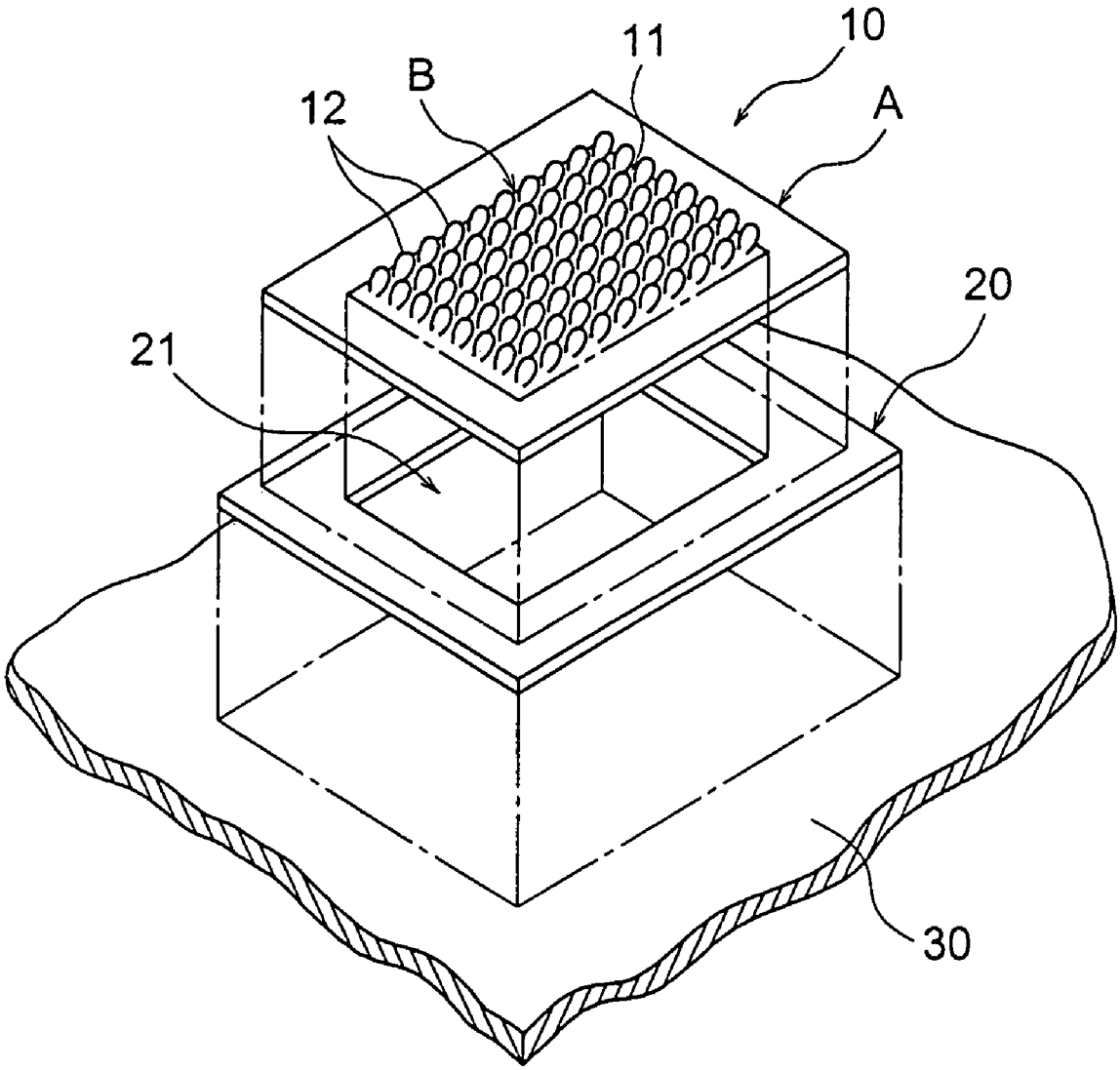
FIG. 1 is an exploded view showing an attaching condition of a noiseless surface fastener member according to a first embodiment of the present invention.
Figure 2:
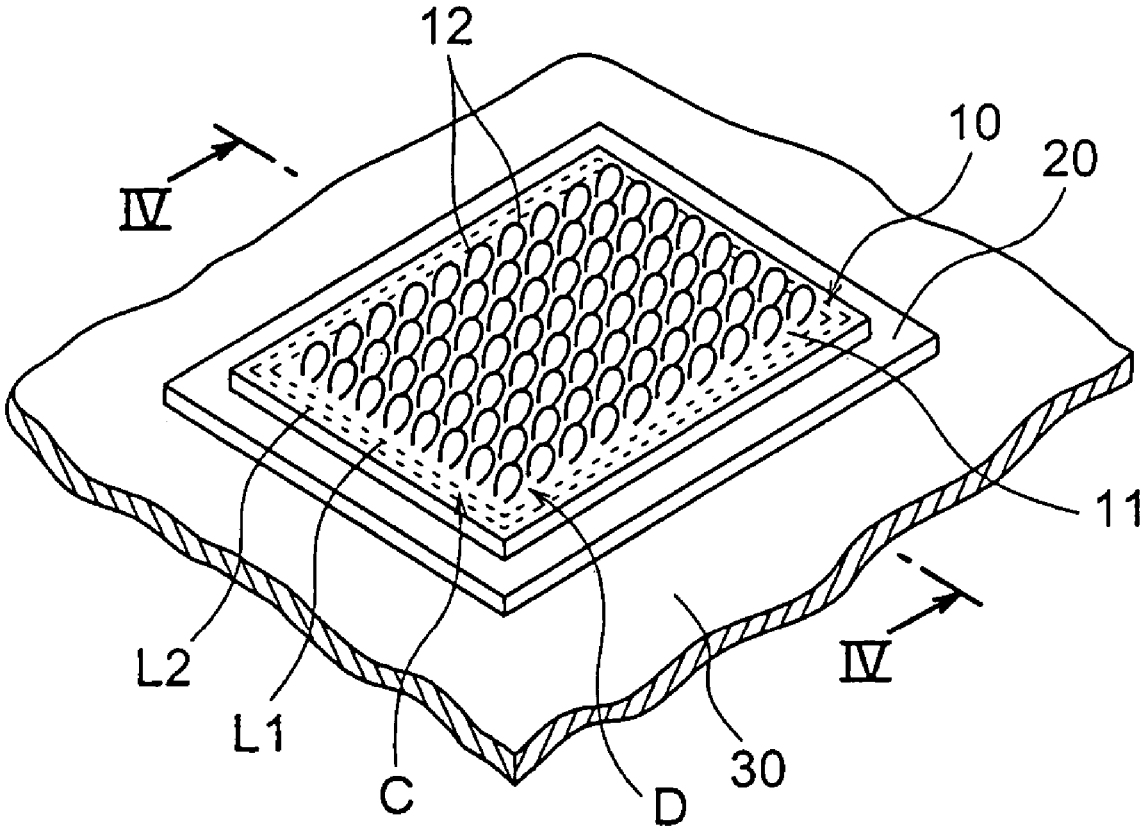
FIG. 2 is a perspective view of major components indicating the attaching condition of the same noiseless surface fastener.

Hereinafter, preferred embodiments of the present inventions will be described in detail with reference to the accompanying drawings. FIGS. 1 and 2 show a first embodiment typical of the present invention.

In this first embodiment, a female surface fastener member, which has a plurality of piles as engaging elements 12 erecting from a surface of a flat base material 11, is exemplified as a surface fastener member 10. However, the surface fastener member of the present invention is not restricted to the female surface fastener member, but may be a male surface fastener member whose engaging elements consist of hook-shaped or mushroom-shaped male engaging elements or may be a surface fastener member in which the male and female engaging elements are mixed. Although a specific structure of the surface fastener flat base material is not shown in the figures, it is a fiber structural material, such as a woven, knitted or unwoven fabric, having any organization.

The surface fastener member 10 of this embodiment is a rectangular piece comprising an engaging-element non-formation region A on which no engaging elements 12 are formed on a periphery thereof and an engaging-element-formation region B located inside the non-formation region A and in which the engaging elements 12 are formed. According to the present invention, a sheet material 20 is attached to a rear surface of the surface fastener member 10 containing no engaging elements 12. This sheet material 20 is larger than the surface fastener member 10 and has a rectangular-frame form in which a rectangular through hole 21 is formed in a center thereof, and this through hole 21 in the center is formed in a rectangle corresponding to the engaging-element-formation region B of the surface fastener member 10. This through hole 21 serves as sound transmission restricting means in the present invention.

Usually, the sheet material 20 is attached to the surface fastener member 10 by sewing with a sewing yarn as shown in FIG. 2. A sewing line L1 exists on the peripheral portion of the through hole 21 of the sheet material 20 and the flat base material 11 corresponding to the engaging-element non-formation region A of the surface fastener member 10.

That is, the surface fastener member 10 and the sheet material 20 are integrated by sewing in a condition that no sheet material 20 exists on the rear surface side of the engaging-element-formation region B of the surface fastener member 10.

According to the present invention, the sewing line L1 corresponds to a sewing region C, and a region formed inside the same sewing region C corresponds to a non-sewing region D. Meanwhile, in this case, the engaging elements 12 may be formed on the engaging-element non-formation region A.

The surface fastener member 10 to which the sheet material 20 is attached at the rear surface thereof is attached to a surface fastener attachment object 30 through the sheet material 20. According to this embodiment, the surface fastener attachment object 30 also consists of a fiber structural material such as a woven, knitted or unwoven fabric although description of any specific structure is omitted. Thus, attachment of the sheet material 20 to the surface fastener attachment object 30 is achieved by sewing with a sewing yarn. A sewing line L2 thereof is located outside the sewing line L1 of the surface fastener member 10 and the sheet material 20.

In this case, the sewing region C corresponds to the sewing lines L1 and L2. The engaging elements 12 may be formed on the sewing lines L1 and L2, too.

The sewing yarn is sewed with large curvatures when the surface fastener member 10, the sheet material 20 and the surface fastener attachment object 30 are sewed together with the sewing yarn. Consequently, as described below, a high sound offensive to the ear, which is generated when an engagement of the surface fastener member 10 in which the engaging elements 12 engage each other is released, is reduced. Further, the surface fastener member 10 and the surface fastener attachment object 30 are not integrated directly; instead, they are integrated through the sheet material 20 having the through hole 21. Moreover, no sheet material 20 exists in a region corresponding to the engaging-element-formation region B or the non-sewing region D of the surface fastener member 10. As a result, when the surface fastener member 10, in which the engaging elements 12 are engaged, is separated, the sound that the engaging elements 12 of the surface fastener member 10 generate is not directly transmitted to the surface fastener attachment object 30. Furthermore, the separation sound transmitted to the sheet material 20 is transmitted through the engaging-element non-formation region A or the non-sewing region D of the surface fastener member 10, so that the transmission efficiency is reduced considerably. Consequently, the level of the sound transmitted to the air is also damped and the sound is lowered, thereby achieving quietness.

Figure 3:
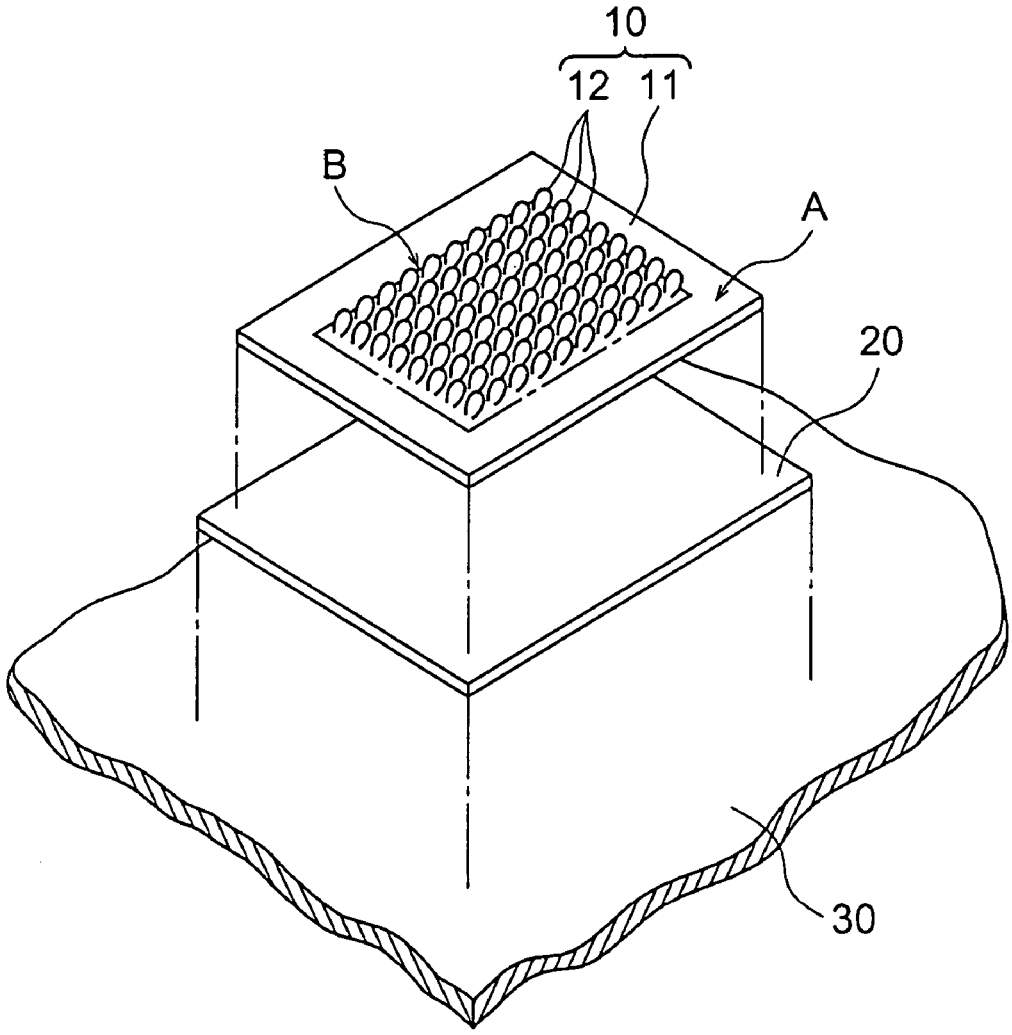
FIG. 3 is an exploded view showing an attaching condition of a noiseless surface fastener member according to a second embodiment of the present invention.

According to this embodiment, the material and structure of the sheet material 20 greatly affect transmission of sound generated upon separation of the surface fastener. For example, by reducing the apparent density of the sheet material 20, even if the through hole 21 as the sound transmission restricting means is not formed as in a second embodiment shown in FIG. 3, the sound transmission is restricted. This apparent density needs to be 0.5 g/cm$^3$ or less. If it exceeds 0.5 g/cm$^3$, sound transmission efficiency is not suppressed, and quietness is not achieved.

In weaving and knitting structures, the apparent density is controlled by adjusting the density of warp and weft yarns or stitch gauge, or designing various kinds of lace patterns. Further, the apparent density can be controlled by employing crimped yarns or bulky yarns for the structural fibers or threads of the fiber structural material. Furthermore, in case of woven, knitted or unwoven cloth, the apparent density can be controlled by controlling the density or height of piles, at the same time when the piles are formed on the surface of the cloth in a regular method.

Table 1 shows a result of measurement on sounds generated when surface fastener members 10 having same material and structures, whose flat base materials 11 are 25-mm-wide knitted materials, are attached by sewing to surface fastener attachment objects 30 having different apparent density. In this experiment, five kinds of fabrics were used as the surface fastener attachment objects 30: a woven fabric having an ordinary plain weaving structure, a synthetic leather, a knitted product, a pile fabric and a fleece, which have apparent density as shown in Table 1.

The sound level (dB) in Table 1 indicates comparison of the sound generated upon separation measured with a microphone located at a distance of 65 mm from each specimen. As evident from Table 1, the sound upon separation depends largely on the density of the surface fastener attachment object 30, and when the apparent density is 0.5 g/cm$^3$ or less, the generated sound is lowered.

The same thing can be said of the surface fastener member 10. Namely, the apparent density of the flat base material 11 of the surface fastener member 10 is preferred to be 0.5 g/cm$^3$ or less. If the apparent density of the flat base material 11 of the surface fastener member 10 and the sheet material 20 are set to 0.5 g/cm$^3$ or less, the sound transmission efficiency is further reduced by a combination of both of the functions, thereby lowering the separation sound generated.

TABLE 1

| Fabric | Material | Apparent density (g/cm3) | Sound level (dB) |
|---|---|---|---|
| Ordinary plain-woven fabric | N6 | 0.51 | 88 |
| Synthetic leather | PVC | 0.68 | 89 |
| Knit | PET | 0.28 | 75 |
| Pile fabric | Cotton | 0.24 | 75 |
| Fleece | PET | 0.15 | 76 |

Further, it is evident from Table 1 that, as well as the apparent density affects the sound transmission, if the composition thread or composition fiber is largely curved, the sound transmission efficiency can be effectively reduced in fiber cloths such as woven, knitted or unwoven fabrics. Generally, knitting yarns are more largely curved than weaving yarns (warp or weft yarns), a knitted fabric have a lower sound transmission efficiency than a woven fabric does if they have ordinary structures. Further, the woven fabric, as described above, is capable of effectively reducing the sound transmission efficiency as well as reducing its apparent density by forming piles therein so that the composition yarns are largely curved. At this time, the curvature is preferred to be 90° or more.

Achievement of quietness at the time of surface fastener separation according to the present invention will be concretely described below by taking up a comparative example, a third embodiment and a fourth embodiment. In the comparative example, the apparent density of the surface fastener member 10 is 0.5 g/cm$^3$ or less while the apparent density of the sheet material 20 is more than 0.5 g/cm$^3$. In the third embodiment, the apparent density of the surface fastener member 10 is 0.5 g/cm$^3$ or less while the through hole 21 is formed in the sheet material 20. In the fourth embodiment, the apparent specific gravities of both the surface fastener member 10 and the sheet material 20 are 0.5 g/cm$^3$ or less. The sound level was measured as in the above-described measurement method.

COMPARATIVE EXAMPLE

A separation sound between a female surface fastener member having nylon loops on its nylon substrate (apparent density: 0.45 g/cm$^3$) of knitting structure and a male surface fastener member having loops on its lace-like substrate (apparent density: 0.50 g/cm$^3$) was 75 dB. Taffeta fabric having a density of 0.60 g/cm$^3$ was attached as a sheet material by sewing to each rear surface of these female and male surface fasteners having a low density. The separation sound of the specimen in which the taffeta fabric was sewed to each rear surface of the surface fasteners was 85 dB.

As understood from this comparative example, even if a surface fastener member whose flat base material has an apparent density of 0.5 g/cm$^3$ or less is employed, if the apparent density of a sheet material to be attached to the rear surface exceeds 0.5 g/cm$^3$, the sound damping function of the surface fastener is lost and conversely, the separation sound of the surface fastener is increased.

(Third Embodiment)

Taffeta fabric having the apparent density of 0.60 g/cm$^3$ was sewed as the sheet material to each rear surface of the same female surface fastener member and male surface fastener member as in the above-described comparative example. The separation sound was 78 dB in a specimen in which a portion of the taffeta fabric where the rear surface of the engaging-element-formation region contacts was cut out so as to form a through hole.

As understood from this embodiment, even if surface fasteners of the same material are used, if a sheet material in which the through hole is formed in a region contacting the rear surface of the surface fastener corresponding to the engaging-element-formation region is attached, the separation sound is 78 dB, which is only slightly larger than 75 dB, which is the separation sound between which the surface fastener members having the sound damping functions.

(Fourth Embodiment)

The separation sound was 76 dB in a specimen in which knitted fabric having the apparent density of 0.28 g/cm$^3$ was sewed as a sheet material to each rear surface of the same female surface fastener member and male surface fastener member as in the comparative example. In this embodiment, the separation sound was smaller than in the third embodiment, and was louder by only 1 dB than in separation of the surface fasteners only.

It is understood from these results that if the apparent density of the sheet material to be attached to the surface fastener member is 0.5 g/cm$^3$ or less, or the through hole is formed in a region corresponding to the engaging-element-formation region or a non-sewing region of the surface fastener member, the sound damping function of the surface fastener is not obstructed.

Figure 4:
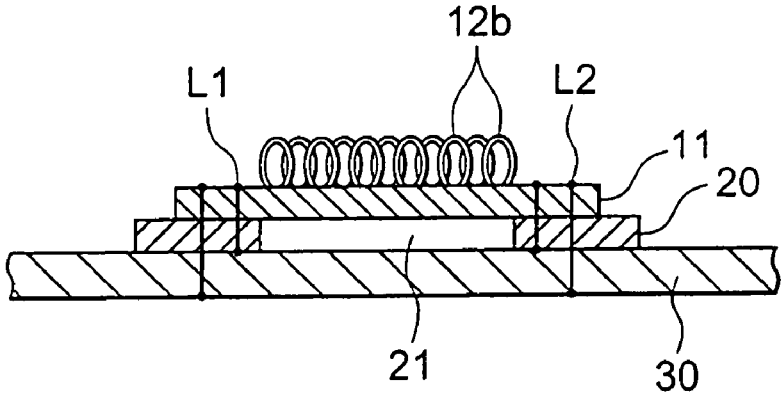
FIG. 4 is a sectional view taken along the line IV—IV of FIG. 2 indicating an example of an attaching structure of the same noiseless surface fastener member.
Figure 5:
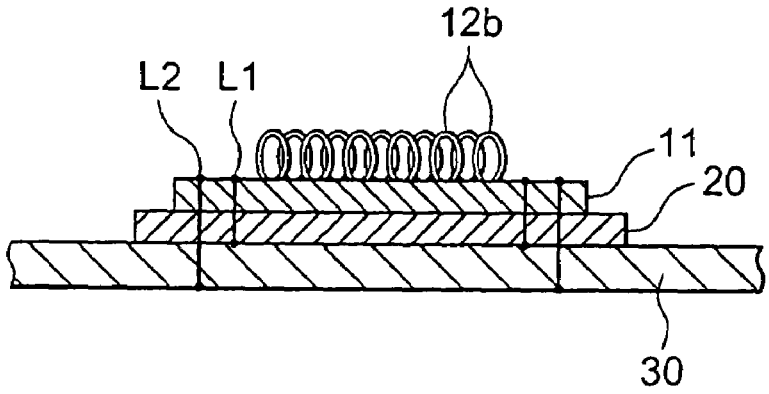
FIG. 5 is a sectional view, similar to FIG. 4, indicating an example of the attaching structure of the noiseless surface fastener member according to the second embodiment.

FIGS. 4 and 5 show examples of attaching structures when the surface fastener member with the sheet material of the present invention is attached to the surface fastener attachment object. FIG. 4 shows an attaching structure of the surface fastener onto the surface fastener attachment object 30 in case where the sheet material 20 includes the through hole 21. FIG. 5 shows an attaching structure of the surface fastener member onto the surface fastener attachment object 30 in case where the apparent density of the sheet material 20 is 0.5 g/cm$^3$ or less. As shown in these figures, the separation sound can be reduced further by preliminarily integrating the surface fastener member 10 and the sheet material 20 by sewing, and then sewing the surface fastener member 10, the sheet material 20 and the surface fastener attachment object 30 outside of a sewing line between the surface fastener member 10 and the sheet material 20, as compared to a case where these components are sewed together at the same time with the same sewing yarn.

Although not shown in the figure, after the surface fastener member 10 and the sheet material 20 are integrated by sewing, the sheet material and the surface fastener attachment object may be integrated by sewing separately and in this case, the separation sound can be further reduced.

Figure 6:
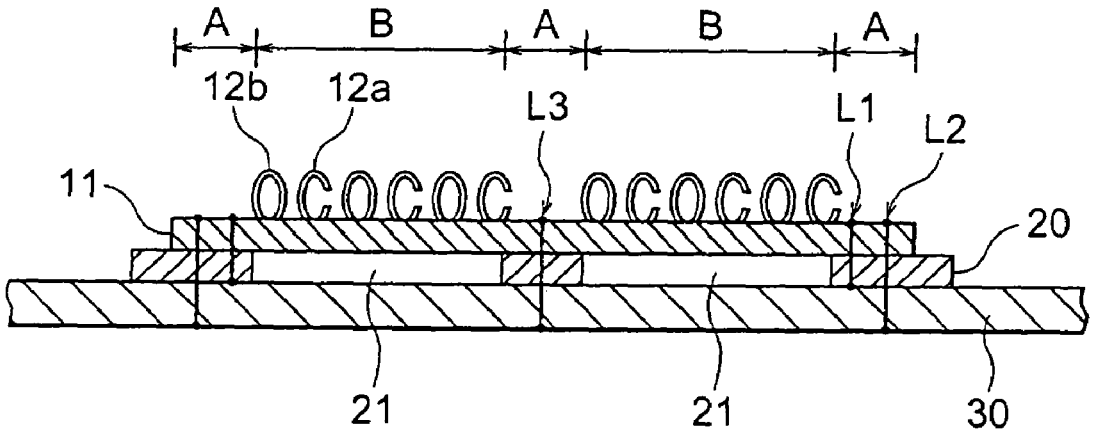
FIG. 6 is a sectional view, similar to FIG. 4, indicating another example of the attaching structure of the noiseless surface fastener member of the present invention.

FIG. 6 shows an example of the attaching structure between the sheet material 20 and the surface fastener attachment object 30 in case where the surface fastener member 10 is large. In the surface fastener member 10 of this example, male engaging elements 12*a* and female engaging elements 12*b* are formed mixedly on the same surface of the same base material 11. In such a mixed-type surface fastener member 10, when, for example, the flat base material 11 is formed by weaving or knitting, mixture of multifilaments and monofilaments is woven or knitted in a loop shape and then, the monofilament loops are partially cut out, so as to form male and female engaging elements 12*a*, 12*b*.

In addition, according to the example as shown in FIG. 6, multiple engaging-element-formation regions B are defined with an engaging-element non-formation region A on the flat base material 11 of the large surface fastener member 10. Through holes 21 of the same shape as or slightly larger than the engaging-element-formation region B are formed in each region corresponding to each engaging-element-formation region B of the sheet material 20. In this embodiment, a pair of engaging-element-formation regions B are formed on the right and left of this figure and the sheet material 20 is attached by sewing to the rear surface of the surface fastener member 10. The attachment in this case is attained by sewing along the sewing line L1 in the non-formation region A surrounding all the engaging-element-formation region B except the engaging-element non-formation region A in the center of the surface fastener member 10. After this sewing is attained, the surface fastener member 10, the sheet material 20 and the surface fastener attachment object 30 are integrated by sewing outside the sewing line L1 and along a sewing line L3 on the engaging-element non-formation region A in the center.

In this case, the sewing region C corresponds to the sewing lines L1, L2 and L3 while a region formed inside the sewing region C corresponds to the non-sewing region D. Meanwhile, in this case, the engaging elements 12 may be formed in the sewing region C (the non-formation region A).

When such a large surface fastener member 10 is attached to the surface fastener attachment object 30 through the sheet material 20, if only the engaging-element non-formation region A on a peripheral portion of the surface fastener member 10 is sewed, a large space is formed between the surface fastener member 10 and the surface fastener attachment object 30, so that the surface fastener member 10 is slackened away the surface fastener attachment object 30. Thus, particularly if the surface fastener attachment object 30 is flexible, the surface fastener attachment object 30 is deformed considerably in the surface fastener attachment region, so that its configuration is difficult to maintain. Further, although this example intends to secure an engaging strength through a large plane by increasing the engaging area of the surface fastener, all its strength is received by the sewing yarn placed along the sewing lines. As a result, when a large separation force is applied, the surface fastener attachment object 30 may be damaged along the sewing lines.

For this reason, according to this embodiment, as described above, the flat base material 11 of the surface fastener member 10 is defined into plurality of the engaging-element-formation regions B with the engaging-element non-formation region A, so that the through holes 21 of the same shape as or slightly larger than the engaging-element-formation region B are formed in the sheet material 20 in a region corresponding to each engaging-element-formation region B. The engaging-element non-formation regions A are formed dispersedly on the surface of the flat base material 11. The surface fastener member 10, the sheet material 20 and the surface fastener attachment object 30 are sewed integrally also in the central portion of the engaging-element non-formation regions A along the sewing line L3.

Figure 7:
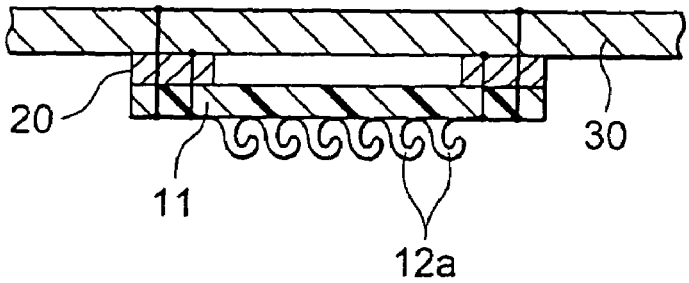
FIG. 7 is a sectional view, similar to FIG. 4, indicating an attaching structure example of the surface fastener member when a molded surface fastener of synthetic resin is employed as the noiseless surface fastener.

The male engaging elements 12*a* of the surface fastener member 10 of the present invention are formed not only by weaving or knitting monofilaments into its (fiber-made) base material 11 in a loop shape and cutting those loops partially as described above, but also by integrally molding male engaging elements on the surface of the base material at the same time when the flat base material is molded of synthetic resin. FIG. 7 shows a sound damping structure in case where the surface fastener member 10 of synthetic resin is employed. As shown in this figure, the attaching structure of the surface fastener member 10 onto the surface fastener attachment object 30 is substantially the same as the attaching structure shown in FIG. 5. If a concave portion or a through hole is formed in the flat base material 11 of the surface fastener member 10, the sound damping effect is improved further.

In the above description, the male engaging elements 12*a* are made by forming hook-shaped pieces by cutting part of the monofilament loops woven or knitted in a loop shape at the same time when the flat base material 11 is woven or knitted. Yet, it is permissible to form spherical engaging head portions at front ends of erected monofilaments by cutting the vertexes of the monofilament loops and melting these vertexes by heat so as to form mushroom-shaped male engaging elements. In the surface fastener of synthetic resin also, the configuration of its male engaging elements are not limited to a hook shape, and it is permissible to form engaging elements having such a special configuration as disclosed in, for example, EP0811331A2.

Figure 8:
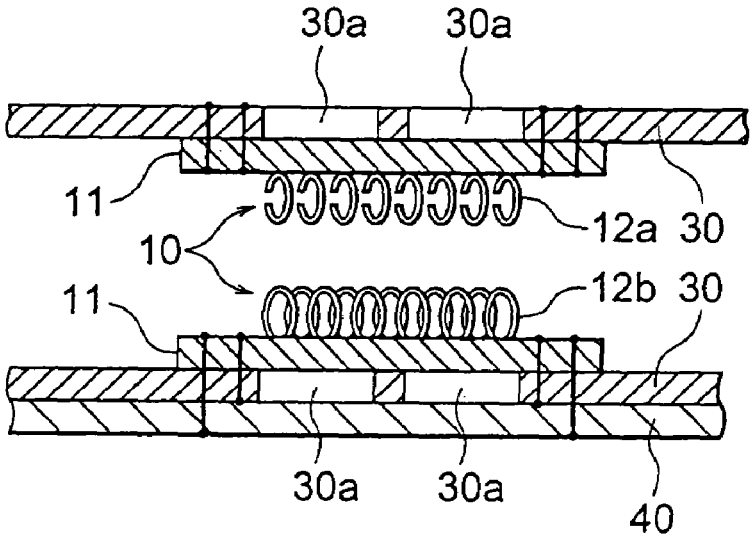
FIG. 8 is a sectional view showing an attaching structure of respective products to which female and male noiseless surface fastener members are attached according to a fifth embodiment of the present invention.

FIG. 8 is a major-portion sectional view showing an attachment condition of a noiseless surface fastener member to a surface fastener attachment object according to a fifth embodiment of the present invention. The surface fastener member 10 used in this embodiment may be a surface fastener having a conventional structure or a surface fastener having sound-damping characteristic attained by reducing the apparent density of the base material of the surface fastener or by forming the through hole.

A feature of this embodiment is that the apparent density of the surface fastener attachment object at least in an attachment region of the surface fastener member 10 is 0.5 g/cm$^3$ or less. Alternatively, if the surface fastener has such a sound-damping structure as in the present invention as described above, the through holes having the same shape as the engaging-element-formation region B or the non-sewing region D are formed at least in regions corresponding to the engaging-element-formation region B or the non-sewing region D so as to form the sound damping structure. Further, according to the embodiment as shown in this figure, when the surface fastener member 10 having the female engaging elements 12*b* is attached to the surface fastener attachment object 30, a backing fabric 40 is attached to the rear surface of the surface fastener attachment object 30.

In this way, by providing at least a surface fastener attachment region of a surface fastener attachment object 30 with the above-described sound transmission restricting means, transmission of a sound generated upon separation is suppressed even in an ordinary surface fastener so that the sound can be lowered as compared to an ordinary condition. In addition, if the strength of the surface fastener attachment region of the surface fastener attachment object 30 is reduced by providing with the sound transmission restricting means, or if the appearance of such a surface fastener is intended to be made better, it is preferable to attach the backing fabric 40 together on the rear surface of the surface fastener attachment object 30.

FIGS. 9 to 12 show typical examples of products provided with the above-described surface fastener member 10.

Figure 9:
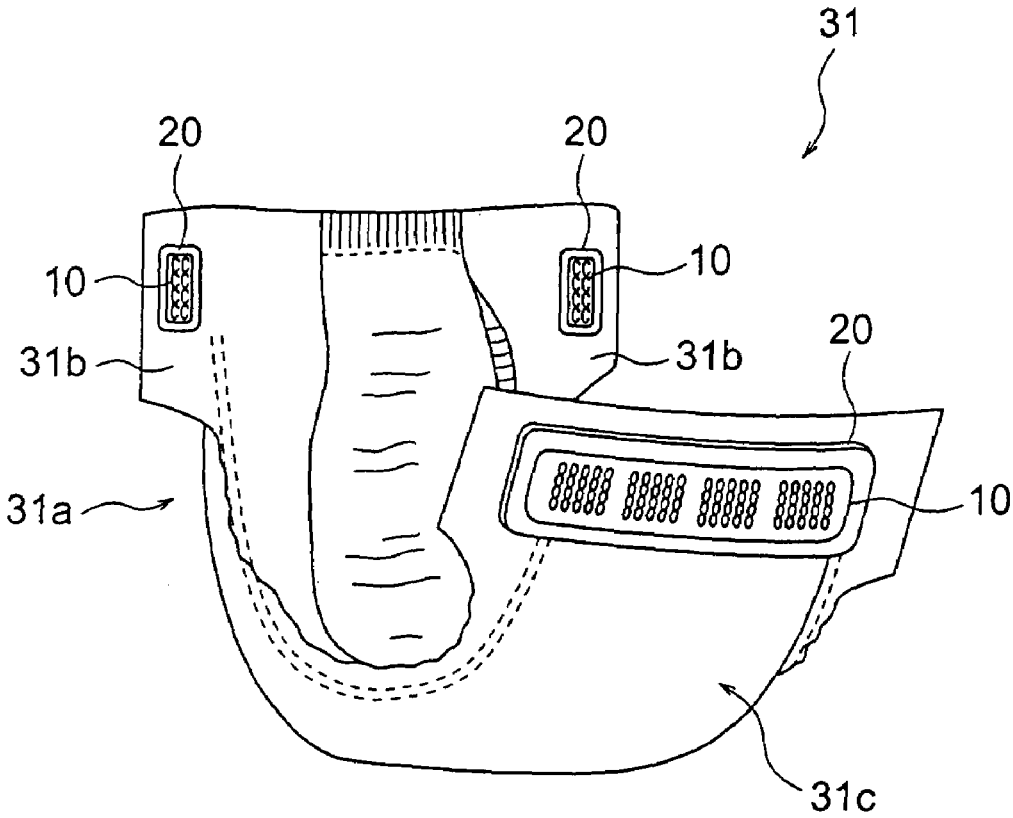
FIG. 9 is an entire perspective view showing an example of a paper diaper to which the noiseless surface fastener of the present invention is attached.

FIG. 9 shows a structural example of a paper diaper 31. The noiseless surface fastener members 10 of the present invention are attached via sheet materials 20 to front faces of a pair of wing pieces 31*b* extending to right and left of a back body portion 31*a* and a front face in a central region at a top end portion of a stomach body portion 31*c* of the paper diaper 31. Attachment of the noiseless fastener member 10 of the present invention to the paper diaper 31 enables the diaper 31 to be replaced quietly without disturbing a baby in its sleep.

Figure 10:
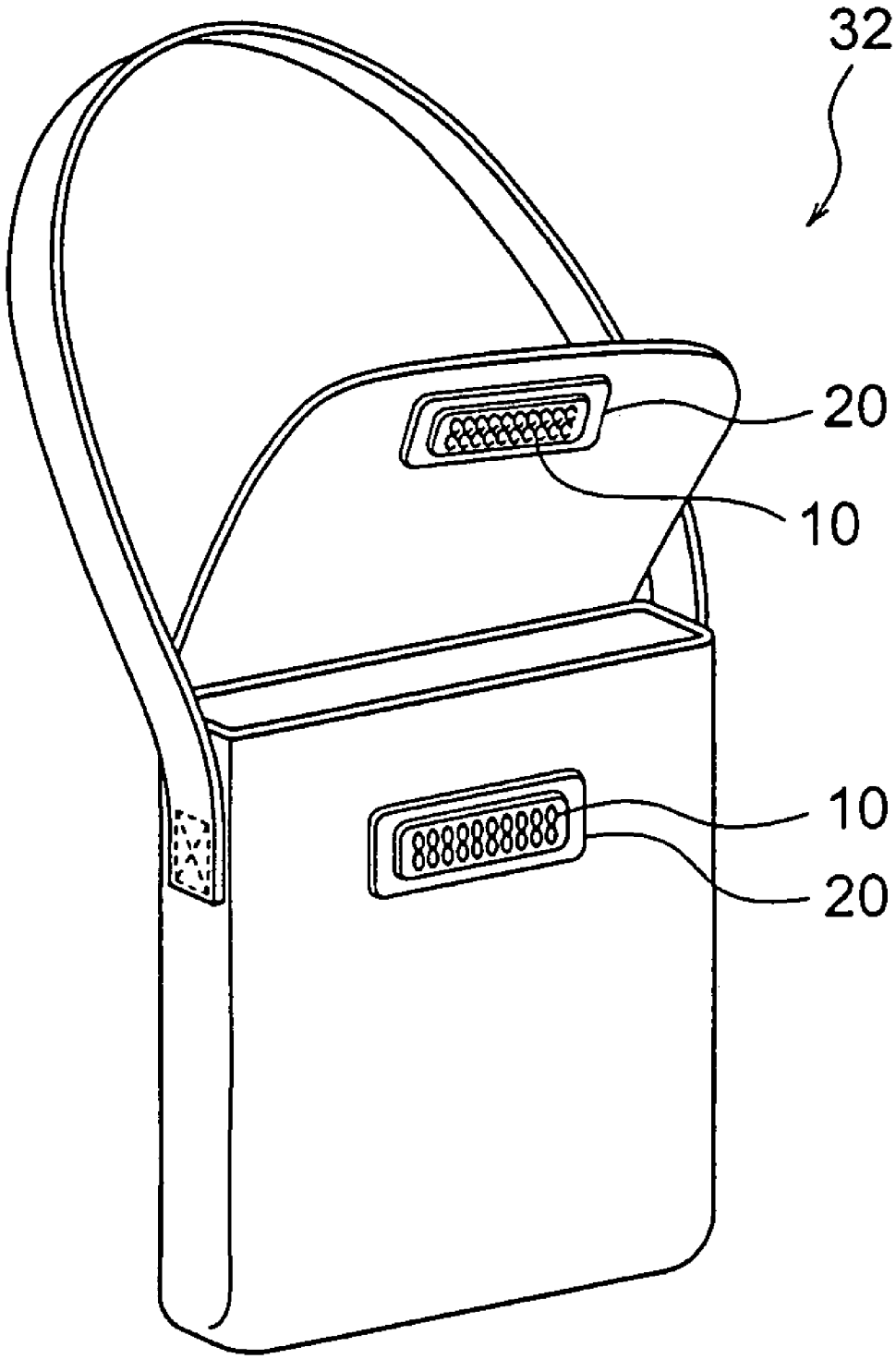
FIG. 10 is an entire perspective view showing an example of a bag with a lid to which the noiseless surface fastener of the present invention is attached.
Figure 11:
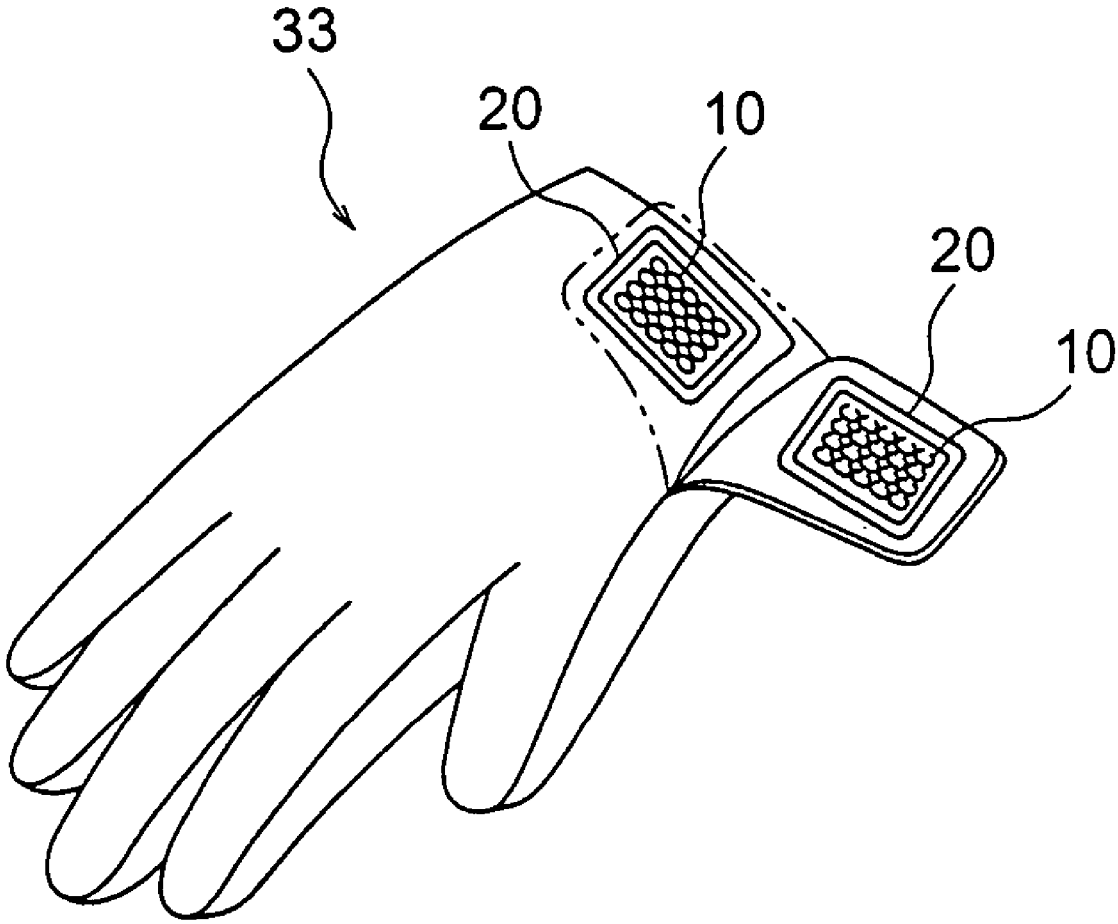
FIG. 11 is an entire perspective view showing an example of a golf glove to which the noiseless surface fastener of the present invention is attached.
Figure 12:
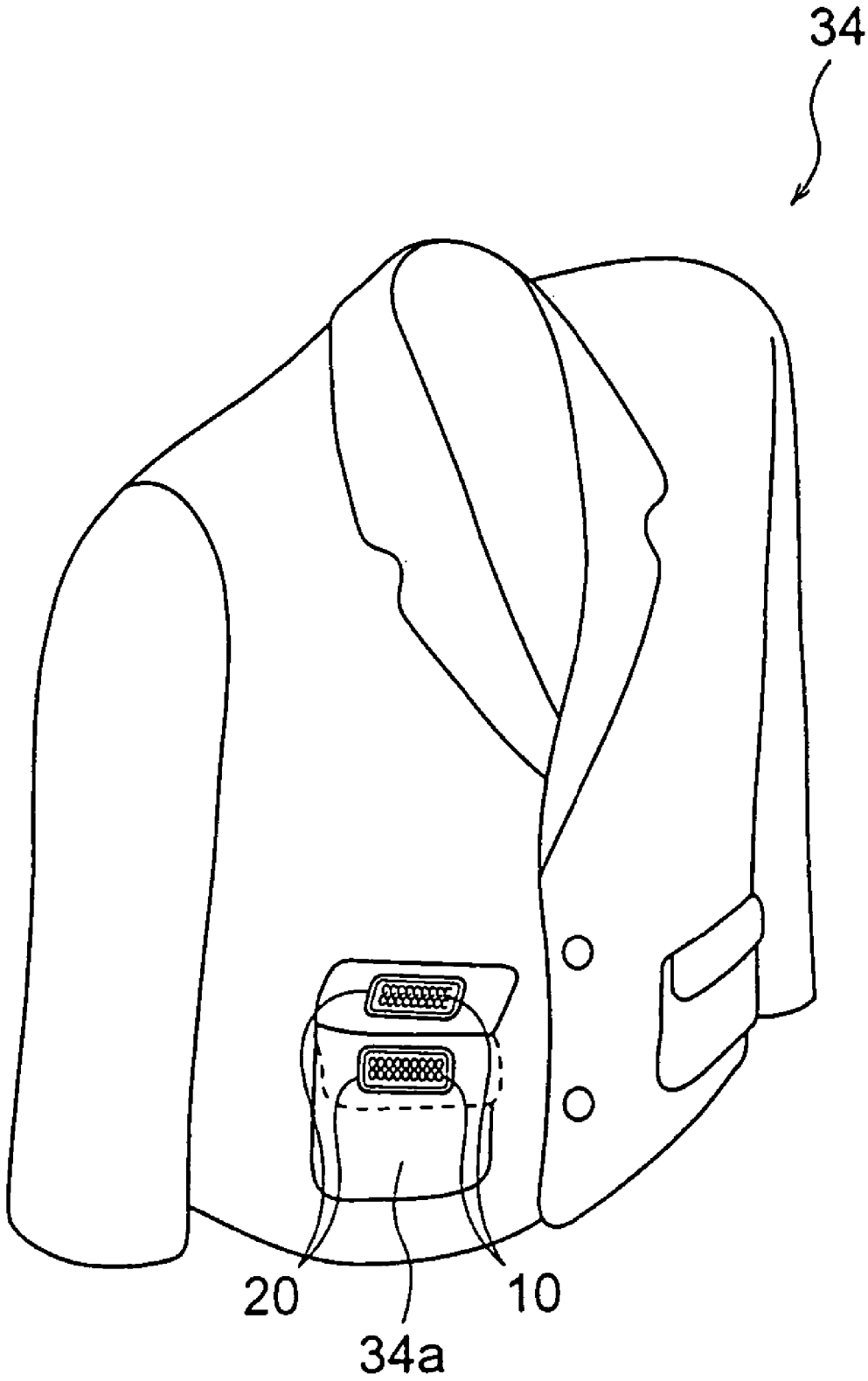
FIG. 12 is an entire perspective view showing an example of a coat to which the noiseless surface fastener of the present invention is attached.

FIG. 10 shows an example of a bag with a lid 32. By providing its opening and closing portion with the noiseless surface fastener member 10 of the present invention having the above-described attachment structure, this bag can be opened or closed quietly without embarrassing surrounding people even at, for example, a library or a concert hall. FIG. 11 shows an example of a golf glove 33. People sometimes take off the golf glove 33 after wearing it during a play, and particularly before going to patting, the glove is often taken out from the hand. At this time, a conventional glove generates a separation sound, which may embarrass other players. If the noiseless surface fastener member 10 of the present invention is attached with the above-described attachment structure, such an anxiety is eliminated, so that the glove 33 can be taken out or worn freely. FIG. 12 shows a condition in which the noiseless surface fastener member 10 of the present invention is attached to the opening and closing portion of a pocket 34*a* of a coat 34 such as an ordinary jacket. Also in this example, the pocket 34*a* can be opened or closed quietly, so no attention is attracted from the surrounding, or surrounding people is never embarrassed.

Next, the noiseless surface fastener which is produced by combination of the fiber surface fastener member according to a preferred embodiment of the present invention will be described with reference to embodiments shown in figures.

Table 2 shows differences of generated sound due to differences of substrate structures of the fiber surface fastener members. "Sound level" in this table was obtained by measuring the generated sound upon separation of a surface fastener with a microphone set 65 mm apart from the surface fastener. The substrate structures of the specimen used are an ordinary plain-woven product (I) having a fine weaving pattern, a warp-knitted product having wale density (per cm) and course density (per cm) as shown in the table, and a plain woven tape (II) having the warp and weft density (per cm) as shown in the table. The apparent density of the plain-woven product (I) was 0.55 g/cm$^3$, the apparent density of the warp-knitted product was 0.45 g/cm$^3$ and the apparent density of the plain woven product (II) was 0.50 g/cm$^3$.

Figure 14A:
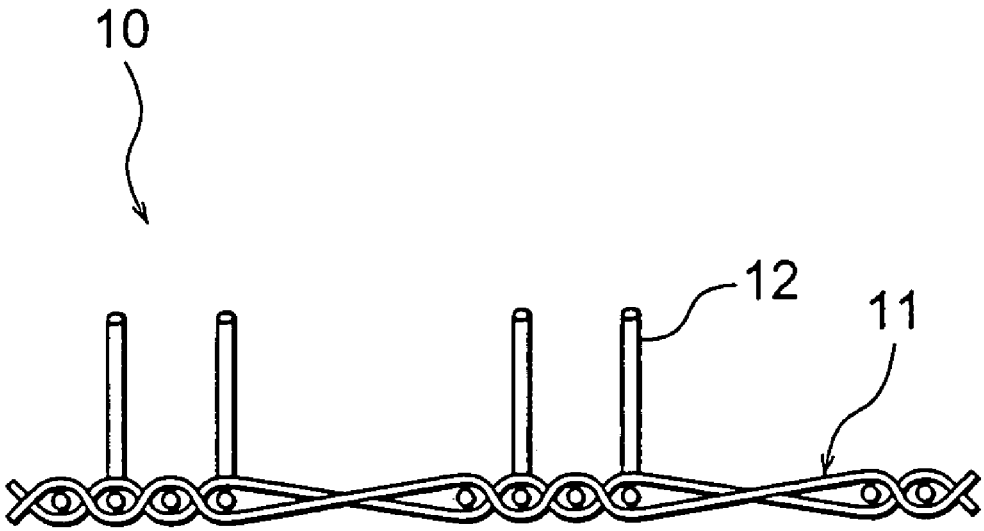
FIGS. 14A and 14B are explanatory diagrams showing warp and weft density of woven base material according to a seventh embodiment of the present invention.
Figure 14B:
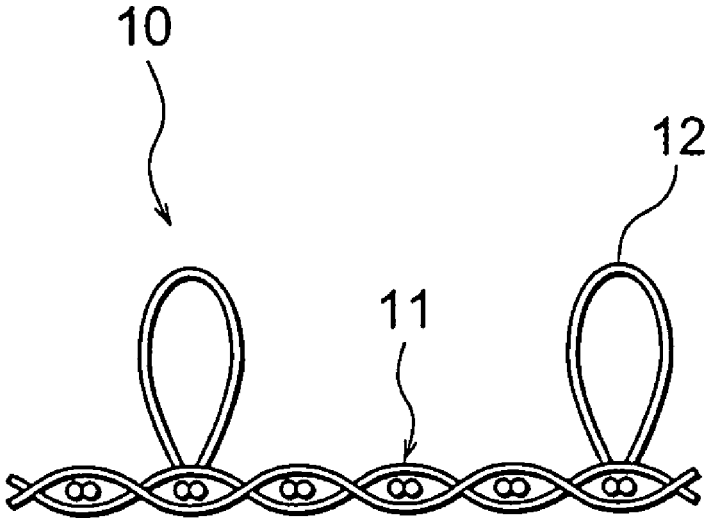

The wale density mentioned here refers to wale count per unit length (1 cm) in the course direction, and the course density refers to a course count per unit length (1 cm) in the wale direction. As indicated in FIG. 14A, the warp density indicates the quantity of warp yarns per unit length (1 cm) in the width direction of woven fabric and the weft density refers to the quantity of weft yarns per unit length in the length direction of the woven fabric as indicated in FIG. 14B, namely, weft count.

TABLE 2

| Structure of the base material | Material | Structure and density of warp and weft yarns or wales and courses | Apparent density (g/cm$^3$) | Sound level (dB) |
|---|---|---|---|---|
| Plain-woven product (I) | Nylon 6 | Warp yarns: 60/cm<br>Weft yarns: 20/cm | 0.55 | 94 |
| Warp-knitted product | Nylon 6 | Wales: 13/cm<br>Courses: 10/cm | 0.45 | 73 |
| Plain-woven product (II) | Nylon 6 | Warp yarns: 30/cm<br>Weft yarns: 15/cm | 0.50 | 74 |

As evident from Table 2, in a base material composed of an ordinary plain woven product (I), the sound level reaches 94 (dB), much larger than other products having ordinary knitting density or a plain woven product (II) having low density. This indicates that when woven fabric is used as the base material of a surface fastener, reducing the weaving density suppresses generation of an abnormal sound at the time of separation, and that using knitted fabric suppresses generation of a separation sound. A large curvature of the composition yarns is thought to suppress the occurrence of the abnormal sound upon separation. Therefore, employing the knitting structure as the base material provides effects of the apparent density and curvature of yarns, and thus the generated sound is estimated to decrease.

Magnitude of vibration at a vibrating portion of the base material can be easily estimated by a following method. All engaging elements except a pair of engaging elements on the base materials of the female and male surface fasteners are removed. Then calcium carbonate powder is applied to the rear surface of the base material and the remaining pair of the engaging elements are engaged and then separated. Calcium carbonate is blown out from a vibrated portion of the base material, so the size of the vibrated portion can be estimated visually. According to an experiment with this method in which base materials of above-mentioned products were used, the diameter of a portion from which calcium carbonate was blown out was 4 mm in an ordinary plain woven fabric. On the other hand, the diameter of a portion from which calcium carbonate was blown was 3 mm in the above-mentioned woven product having a low weaving density. This indicates that it is effective to rough the weaving or knitting structure of the base material.

Figure 13:
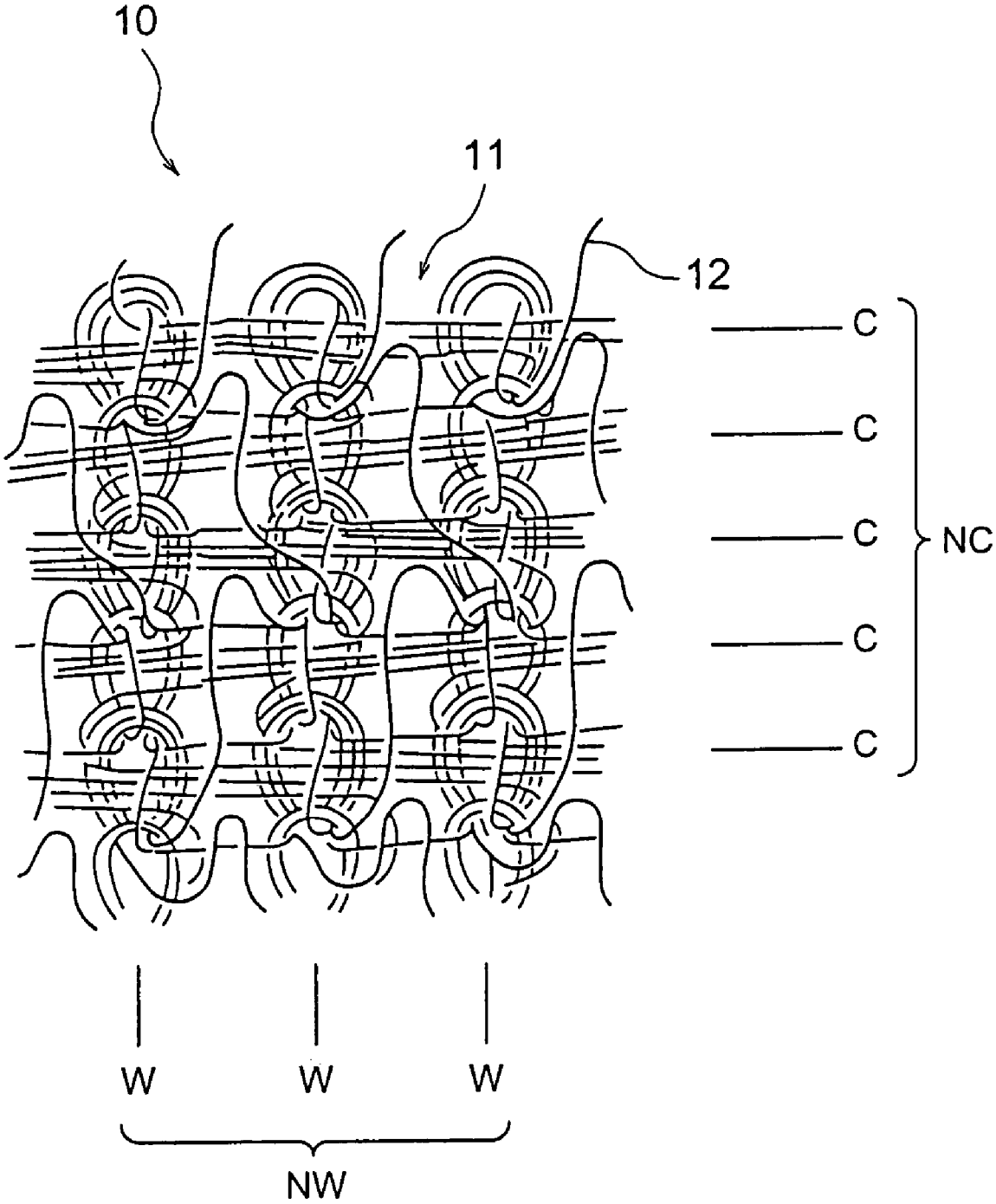
FIG. 13 is an explanatory diagram showing wale density and course density of a knitted base material of a noiseless surface fastener member according to a sixth embodiment of the present invention.

When a knitted product is employed as the base material, as shown in FIG. 13, the applicants have realized as a result of numerous experiments that, when the repetitive count (quantity) of the wale per unit length is defined as NW (per cm) and the repetitive count (quantity) of the course per unit length is defined as NC (per cm), the separation sound can be reduced effectively if NW+NC is 5.9 or more and 29.0 or less. Further, if a woven fabric is employed as the base material, the above-described condition can be satisfied if, as for the weaving density, the weft density is 18.0/cm or less and the warp density is 37.5/cm or less, and at the same time, weft-yarn size is 140 to 300 deniers and warp-yarn size is 140 to 300 deniers, while loop yarns, which are composition yarns of engaging elements, are 450 deniers. Furthermore, lowering the density by adjusting a bulk of composition yarns is also effective, and crimp yarns can be used, too. The crimp yarn itself has a bulk so that its woven fabric becomes bulky while its density drops.

A ratio between storage modulus and loss modulus of a yarn can be improved by mixed fiber spinning. Particularly, if fibers of material having a tan-delta peak near a room temperature such as urethane fiber are mixed, the loss modulus of a yarn increases remarkably. Material whose glass transition temperature is low and whose crystallization degree is small, such as low-density polyethylene (LDPE) is also effective. If the loss modulus is increased as described above, a range in which vibration propagates becomes narrow thereby reducing the size of a speaker cone. Further, if the base material is formed in a lace-like structure, yarns transmitting vibration is bent at multiple points, the number of yarns for transmitting the vibration is decreased, and the apparent density drops, which is more effective.

Figure 15:
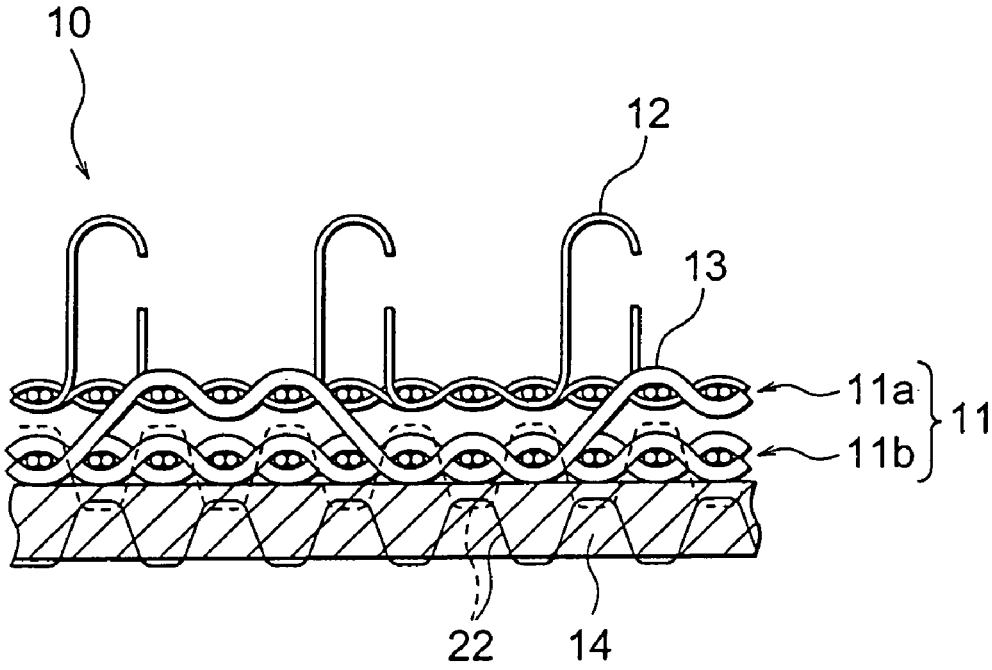
FIG. 15 is a partially sectional view of a product provided with a typical fiber-made noiseless surface fastener of the present invention.

FIG. 15 schematically shows a condition in which the noiseless fiber surface fastener member of the present invention is attached to the fabric, which is an attachment object. In the meantime, in the following description of embodiments, the same reference numerals are attached to portions, which do not need to be distinguished in terms of function and which can be handled as substantially same portion, like the base material and the male/female engaging elements. The reference numeral of the surface fastener member is 10 regardless of male or female, the reference numeral of the base material is 11 regardless of weaving or knitting, and the reference numeral of the engaging element is 12 regardless of male or female.

Figure 16:
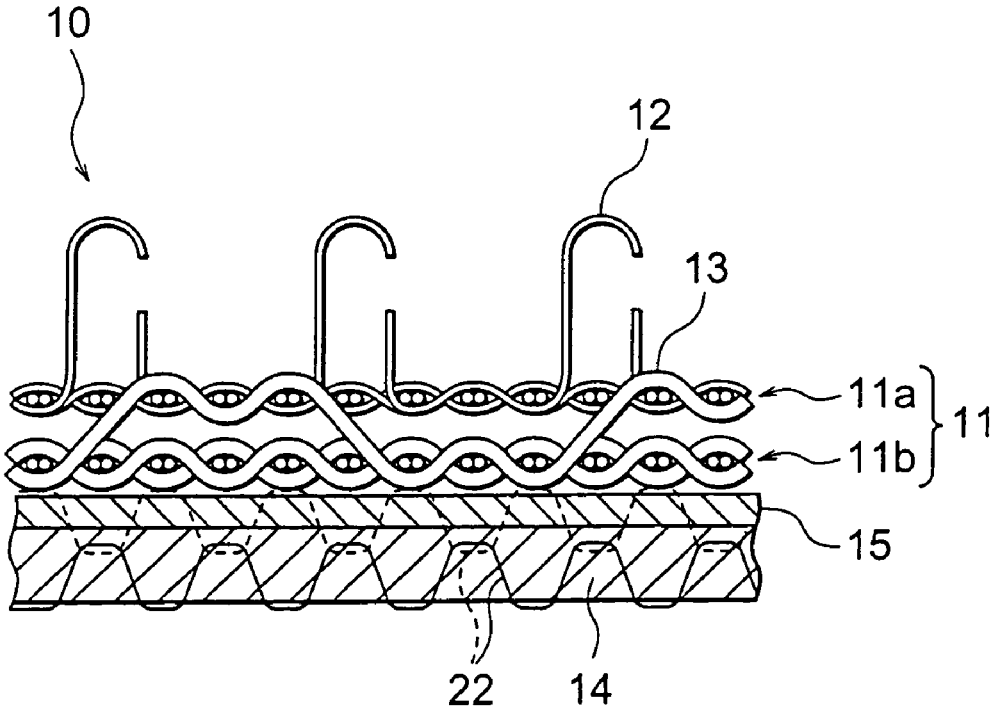
FIG. 16 is a partially sectional view of a product provided with another fiber-made noiseless surface fastener member of the present invention.

The noiseless surface fastener member 10 according to an embodiment shown in FIG. 16 is composed of a woven fabric produced by weaving monofilaments while forming loops at the same time when the base material 11 is woven and cutting part of the loops so as to form hook-shaped male engaging elements 12 integrally with the same base material. The base material 11 is a double-woven fabric composed of upper and lower layers and those two layers consist of plain-woven structures. The upper and lower layers 11*a*, 11*b* are coupled by a coupling yarn 13 which is used as part of the warp yarns. At this time, according to this embodiment, by making the coupling yarn 13 slightly slack, a gap is formed between the upper layer 11*a* and the lower layer 11*b*. Although the base material 11 is constituted of double-woven fabrics in the example shown in this figure, it may be of triple-woven fabric or multiple-woven fabric.

If the apparent density of at least a layer including a base layer having the engaging elements 12, the layer being a multiple-woven or multiple-knitted fabric, is reduced to 0.5 g/cm$^3$ in order to restrict transmission of vibration further, vibration generated near the engaging elements 12 becomes more unlikely to be transmitted to the cloth. In this embodiment also, the apparent density of an entire base material 11 can be set to 0.5 g/cm$^3$ or less. The apparent density at this time can be calculated easily based on the thickness of the base material 11 and property (density) of composition yarns of the base material as well as the weight per unit volume (cm$^3$).

If the base material 11 is composed of a double-woven fabric and its apparent density is set to 0.5 g/cm$^3$ or less, the base material 11 can be provided with a high damping capacity against vibration. Further, when a cloth 14 is sewed with sewing yarn to the male fastener member, vibration generated at the upper layer 11*a* upon disengagement (separation) from the mating female fastener member (not shown) is damped considerably before transmitted to the lower layer and then propagated to the cloth 14. Thus, the vibration generated upon separation is damped by the damping capacity of the base material 11 itself and a decreased level of the vibration transmitted to the cloth 14. As a result, the complex vibration as a whole is reduced largely, so that radiation amount of abnormal sound into the air becomes very small.

Particularly in the present invention, it is important to set the apparent density of a mating female surface fastener which engages the male surface fastener 10 to 0.5 g/cm$^3$ or less and this combination greatly suppresses the sound generated upon separation.

Figure 17:
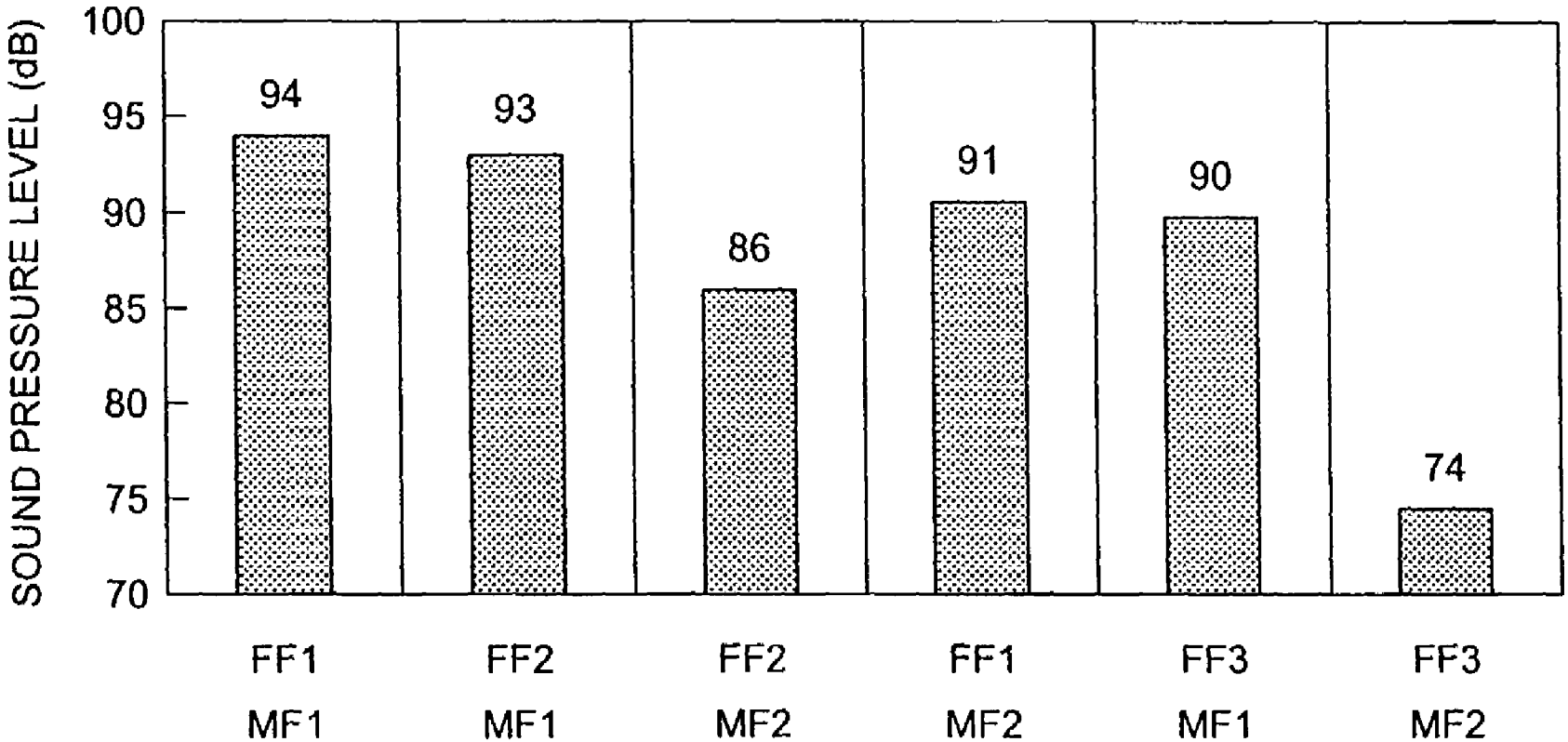
FIG. 17 is a comparative diagram showing the level of a sound generated when surface fastener members with different apparent densities in their base materials are separated from each other.

FIG. 17 shows differences of sound pressure levels (dB) when repeating engagement and separation between first to third female surface fastener members FF1, FF2 and FF3 with apparent density of 0.71, 0.65 and 0.33 (g/cm$^3$) respectively and two kinds of male surface fasteners MF1 and MF2 with apparent density of 0.68 and 0.42 (g/cm$^3$) by changing the combination therebetween.

As understood from this figure, in combinations of male and female surface fastener members MF1/FF1 and MF1/FF2 each having the apparent density of more than 0.5 g/cm$^3$, sound pressure levels generated upon separation exceed 93 dB, which indicates a sound very offensive to the ear. On the other hand, if the apparent density of one of male and female surface fastener members is set to 0.5 g/cm$^3$ or less while the apparent density of the other surface fastener member is set to more than 0.5 g/cm$^3$ so as to prepare such a combination as MF2/FF1, MF2/FF2 and MF1/FF3, the sound pressure level is 86 dB at the lowest. In contrast, if the male and female surface fastener members MF2 and FF3, whose apparent density are both 0.5 g/cm$^3$ or less, are combined, the sound pressure level generated upon separation greatly drops to 74 dB, which indicates a low sound little offensive to the ear.

According to this embodiment, a special sewing machine called "face sewing machine" (YAMATO SEWING MACHINE MFG CO. LTD) is employed to attach the noiseless surface fastener member 10 to the cloth 14. As shown in FIG. 15, an upper layer 11*a* of the base material 11 is not sewed directly and only the lower layer 11*b* and the cloth 14 is sewed. Consequently, a gap between the upper layer 11*a* and the lower layer 11*b* is not eliminated, so that the upper layer 11*a* is not affected by fixing with the sewing yarn 22. As a result, vibration generated at the upper layer 11*a* is greatly damped during transmission to the lower layer 11*b*. Speaking of a sewing mechanism of the sewing machine simply, a curved needle called curved advancing needle is used and this needle sews by scooping up to half in the thickness of the cloth.

As for how to attach the noiseless surface fastener member 10 to the cloth 14, in addition to the embodiment shown in FIG. 15, if the noiseless surface fastener member 10 is small, it is permissible to sew the noiseless surface fastener member 10 so as to include the upper layer 11*a* along the edge portion thereof as in ordinary sewing. Alternatively, if the noiseless surface fastener member 10 is large, it is permissible to sew the surface fastener member 10 so as to include the upper layer 11*a* in a grid form having a predetermined interval.

A sound upon separation of the surface fastener is generated from not only the surface fastener but also a product which the surface fastener is attached to if the vibration is transmitted to the product. Therefore, it is not sufficient to merely lower the sound from the surface fastener upon separation but it is necessary to consider the attachment structure to the product. U.S. Pat. No. 4,884,323 discloses interposing of a large-volume material containing air between the surface fastener and the cloth. Also in the present invention an unwoven fabric 15, for example, may be interposed between the surface fastener member 10 and the cloth 14, as shown in FIG. 16. In the example shown in this figure, the unwoven fabric 15 is preliminarily attached by sewing to a surface-fastener-attachment face of the cloth 14 and then, the male surface fastener member 10 is attached to the front surface of the unwoven fabric 15. At this time, the sewing means shown in FIG. 15 can be adopted to fix the male surface fastener member 10 and the cloth 14. Alternatively, the periphery of the male surface fastener member can be sewed or the male surface fastener member 10 can be sewed in a grid form.

Furthermore, the present invention includes formation of a gap, which is for interrupting transmission of vibration generated upon separation to the cloth, on the rear surface of the surface fastener member. This gap can be formed integrally with the base material without adding further steps such as a sewing process and provides a surface fastener which can damp a sound generated upon separation. In means for forming the gap at the rear-face side of the surface fastener member according to the present invention, the gap is molded three-dimensionally when the base material of the surface fastener member is woven or knitted. Alternatively, the rear surface side of the back-coating layer is molded unevenly when back-coating agent is hardened after the base material is woven or knitted. Further methods include weaving only the edge portion of the surface fastener in multiple layers and using bold structural yarns for the edge portion, thereby increasing the thickness of the edge portion. Alternatively, the sound damping effect can be improved further by folding back the edge portion or combining the above methods.

Figure 18:
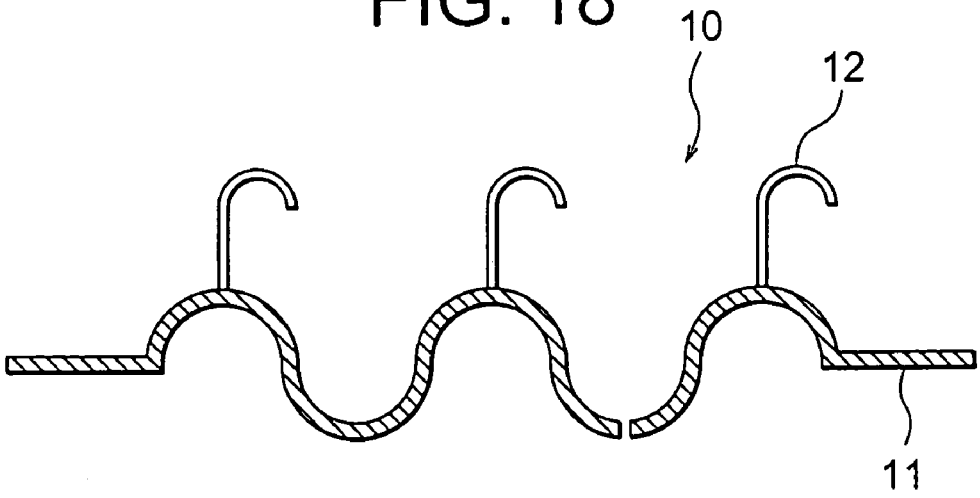
FIG. 18 is a partially sectional view showing another typical fiber-made noiseless surface fastener member of the present invention.
Figure 19:
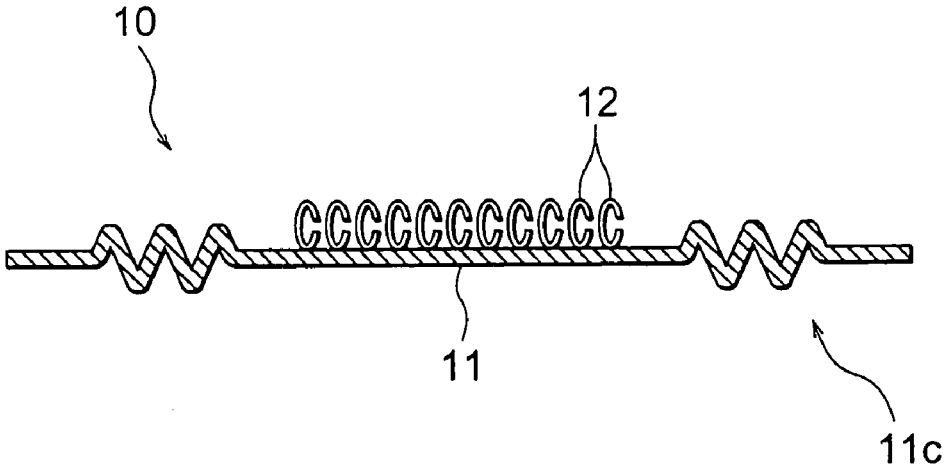
FIG. 19 is a partially sectional view showing still another typical fiber-made noiseless surface fastener member of the present invention.
Figure 20:
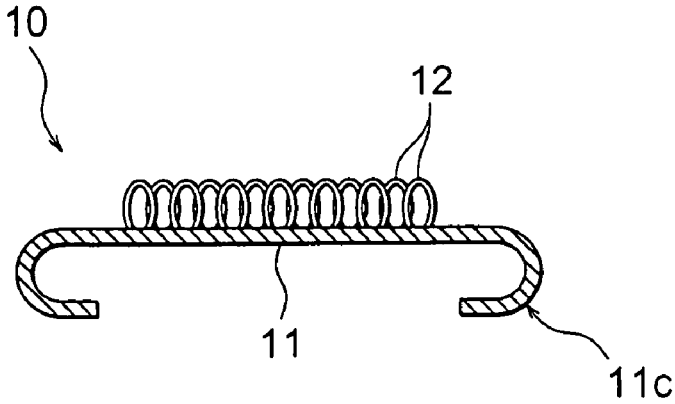
FIG. 20 is a partially sectional view showing still another typical fiber-made noiseless surface fastener member of the present invention.

FIGS. 18 to 20 show other typical embodiments of the present invention. According to these embodiments, after the surface fastener member 10 is woven or knitted, the base material 11 is formed into waving shape by heat treatment with a die (not shown) (FIG. 18), an ear portion 11*c* of the base material 11 is formed into a zigzag shape (FIG. 19), or the ear portion 11*c* of the base material 11 is curved by 90° to the rear face side of the base material 11 (FIG. 20). If the surface fastener member 10 having such a configuration is attached to a cloth (not shown), a gap is formed between the surface fastener member 10 and the cloth 14, so that the level of the sound generated upon separation of the surface fastener is reduced effectively. Meanwhile, the engaging elements 12 of the surface fastener member 10 shown in FIG. 20 are formed by weaving multifilaments, which is composed of multiple continuous fibers, as a single thread in the form of loops in the base material 11. These loops are later subjected to buffing treatment with this configuration without being cut and employed as a female engaging element.

Figure 21:
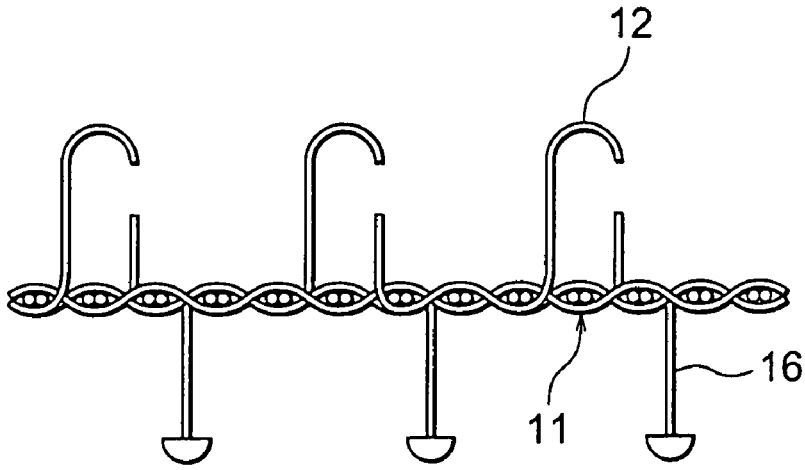
FIG. 21 is a partially sectional view showing still another typical fiber-made noiseless surface fastener member of the present invention.
Figure 22:
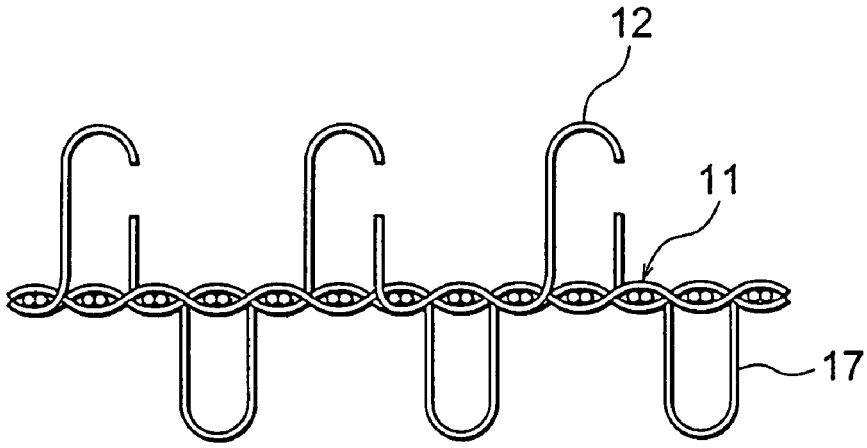
FIG. 22 is a partially sectional view showing still another typical fiber-made noiseless surface fastener member of the present invention.
Figure 23:
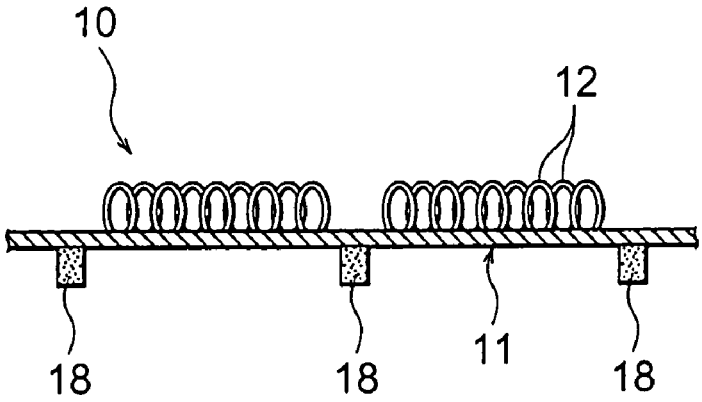
FIG. 23 is a partially sectional view showing still another typical fiber-made noiseless surface fastener member of the present invention.
Figure 24:
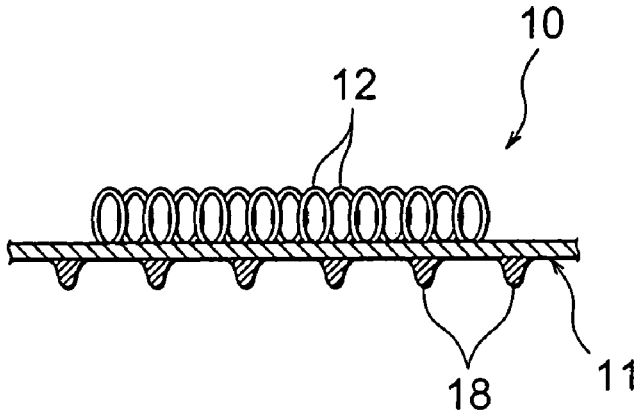
FIG. 24 is a partially sectional view showing still another typical fiber-made noiseless surface fastener member of the present invention.

In addition, according to the present invention, transmission efficiency upon transmission of vibration can be dropped by contacting the surface fastener member 10 and the cloth 14 in a dot-like or linear manner. As its specific method, as shown in FIGS. 21 and 22, the engaging elements 12 are formed on the front surface of the base material 11 upon weaving or knitting, and loops are formed on the rear surface thereof. Then, rectangular columnar protrusions 16 having head portions at end portions thereof are formed by cutting vertexes or side portions of these loops, or pile-like protrusions 17 are formed without cutting these loops. Alternatively, as shown in FIGS. 23 and 24, resin 18 is pressed out to the rear surface of the base material 11 of the surface fastener member 10 in a dot-like or linear form so as to be attached integrally to the base material 11. Although the resin 18 for use is not restricted to any one, low-temperature vulcanized rubber base resin is appropriate when considering plasticity and processability. Also, depending on the usage, it is permissible to use a resin which is mainly composed of vinyl acetate and can be processed under low temperature. In addition, various kinds of foamed resins can be used.

Figure 25:
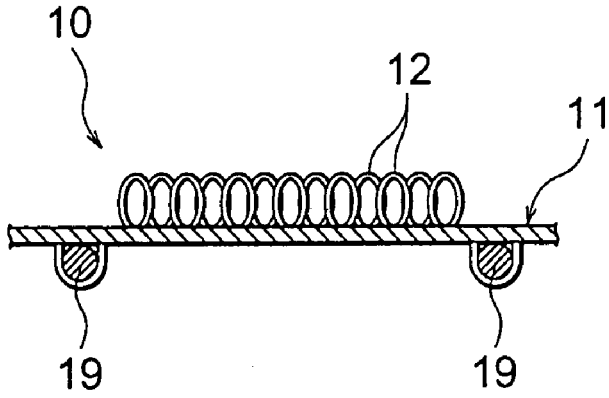
FIG. 25 is a partially sectional view showing still another typical fiber-made noiseless surface fastener member of the present invention.
Figure 26:
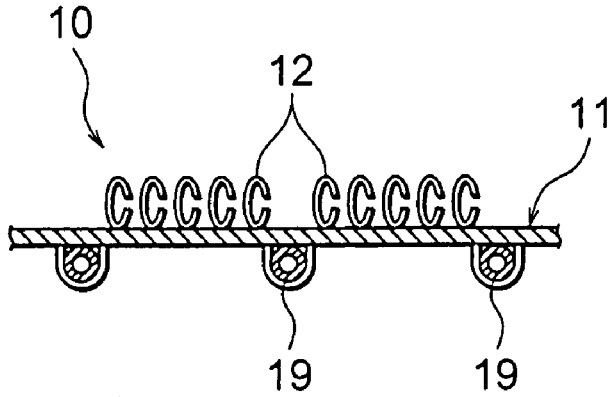
FIG. 26 is a partially sectional view showing still another typical fiber-made noiseless surface fastener member of the present invention.
Figure 27:
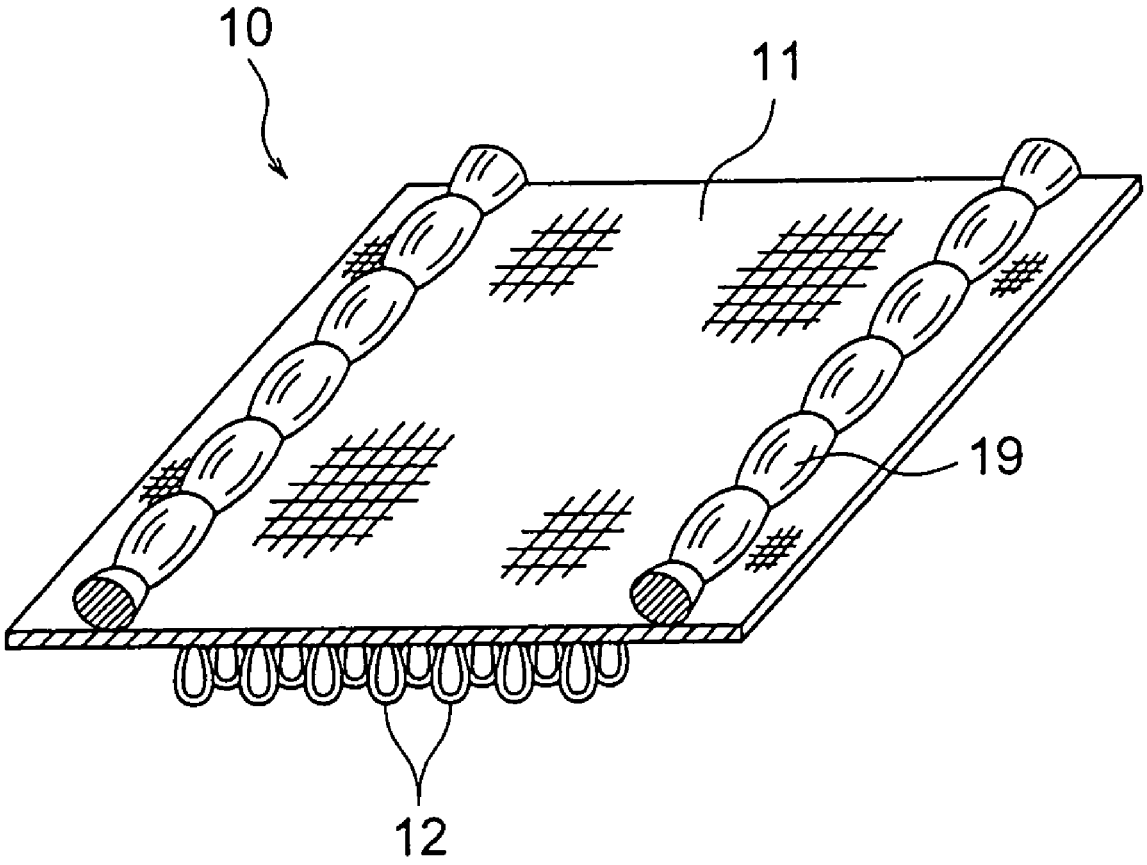
FIG. 27 is a perspective view of the surface fastener members as seen form a rear face side thereof.

As shown in FIGS. 25 to 27, it is permissible to attach linear bodies 19 such as cotton yarns and cotton strings or the linear bodies 19 having pipe-line shape, on the rear surface of the surface fastener member 10 on which no engaging elements 12 are formed, so as to be integrated with the base material 11. Although the linear bodies 19 may be attached by sewing, it is more preferable to weave or knit the linear bodies 19 into the base material 11 at the same time when the base material 11 is woven or knitted, because it takes no labor or does not increase the number of steps. When the surface fastener member 10 is attached to the cloth 14 by means of this structure, vibration which is generated at the base material 11 upon separation and is transmitted to the cloth 14 is greatly reduced, and a remarkable sound damping effect can be obtained.

In the above descriptions, one of the male and female surface fastener members, which are component members of the surface fastener member 10, is exemplified. Yet, the present invention allows the male engaging elements and the female engaging elements to be mixed on a single face of the base material 11 of the surface fastener member 10, although it is not shown in figures. An important point of the present invention is that both surface fastener members, which act as a pair, need to satisfy following two conditions of the present invention. (1) The apparent density of each surface fastener member is 0.5 g/cm$^3$ or less. (2) The entire base material 11 of at least one surface fastener member 10 has substantially uniform fiber density. With such a structure, in addition to sound damping effect, uniform engagement ratio and engagement strength can be obtained at an entire face of the surface fastener, and when the surface fastener members 10 are joined, the configuration of the joined portion is stabilized.

Further, in the noiseless surface fastener according to the present invention, when back-coating is carried out on the surface fastener member, it is permissible to apply bead-like resin before the back-coating agent is hardened, so that the bead-like resin is attached to the rear surface of the surface fastener through the back-coating agent, although it is not shown in the figure. The configuration of the bead-like resin is not limited to any particular one, and spherical, linear or other various configurations can be adopted. It is permissible to preliminarily mix the bead-like resin in the back-coating agent and apply this to the rear surface of the surface fastener member.

Table 3 shows sound levels generated upon separation of the surface fastener member 10, to which warp knitting structure is adopted as the base material 11 thereof and which is sewed on various kinds of the cloths 14. In this table, the "apparent density" indicates a weight per unit volume of each of the various cloths and the "apparent density of the surface fastener base material" indicates a weight per unit volume of the base material 11. In order to estimate the sound level, a 25-mm wide surface fastener whose base material is a warp knitted fabric was attached to each fabric, a microphone was disposed 65 mm far from a joined portion of the surface fastener and then, its separation sound was measured.

TABLE 3

| Fabric | Material | Apparent density (g/cm3) | Apparent density of the surface fastener base material (g/cm3) (Male surface fastener/ Female surface fastener) | Sound level (dB) |
|---|---|---|---|---|
| Ordinary plain-woven fabric | N6 | 0.51 | 0.42/0.36 | 88 |
| Synthetic leather | PVC | 0.68 | 0.42/0.36 | 89 |
| Knit | PET | 0.28 | 0.42/0.36 | 75 |
| Pile fabric | Cotton | 0.24 | 0.42/0.36 | 75 |
| Fleece | PET | 0.15 | 0.42/0.36 | 76 |
| Ordinary plain-woven fabric | N6 | 0.51 | 0.68/0.71 | 95 |

As evident from Table 3, the sound upon separation deeply depends on the apparent density of the cloth, and when the apparent density is 0.5 g/cm$^3$ or less, the generated sound becomes small. This indicates that if the apparent density of cloth is 0.5 g/cm$^3$ or less, the sound generated upon separation of the surface fastener can be further suppressed.

Moreover, if a fastener base material with its apparent density of 0.5 g/cm$^3$ or less is employed and is attached to the cloth, which is an attachment object, through a fabric such as a pile-knitted fabric or an unwoven fabric whose apparent density is 0.5 g/cm$^3$ or less, the generated sound can be suppressed.

As described above, the noiseless surface fastener with the sheet material and the product attached with the same surface fastener can remarkably lower a high sound offensive to the ear generated upon separation of the surface fastener. Thus, one can engage or disengage such a surface fastener without taking care of the surrounding even at places where abnormal sounds are unfavorable. In the meantime, the above description refers to only typical examples of the present invention, and it is obvious from the above description that the present invention may be modified in various ways within the scope of the present invention.

What is claimed is:

1. A noiseless surface fastener made of fiber comprising a surface fastener member having a joining face and multiple engaging elements made of fiber at any one of a front surface and a rear surface of a fiat base material composed of fiber structural material, wherein apparent density of the base material of the fiber surface fastener member to be engaged is 0.5 g/cm$^3$ or less, at least the flat base material of one the surface fastener member has a substantially uniform fiber density on an entire surface theerof, and the base material of the surface fastener member has a knitting structure, and wale density NW (wale count/cm) and course density NC (course count/cm) of knitting satisfy the following equation:

$$5.9 \leqq NW+NC \leqq 29.0.$$

2. A product having vibration absorption means between an article having the noiseless surface fastener according to claim 1 attached thereto and the surface fastener.

3. A noiseless surface fastener made of fiber comprising a surface fastener member having a joining face and multiple engaging elements made of fiber at any one of a front surface and a rear surface of a flat base material composed of fiber structural material, wherein apparent density of the base material of the fiber surface fastener member to be engaged is 0.5 g/cm$^3$ or less, at least the flat base material of the surface fastener member has a substantially uniform fiber density on an entire surface thereof, and the base material of the surface fastener member has a weaving structure having warp density of 37.5 per cm or less, weft density of 18.0 per cm or less and size of warp and welt yarns of 140 to 300 deniers.

4. A product having vibration absorption means between an article having the noiseless surface fastener according to claim 3 attached thereto and the surface fastener.

5. A noiseless surface fastener made of fiber comprising a combination of surface fastener members each of which has a joining face and multiple engaging elements made of fiber at any one of a front surface and a rear surface of a flat base material composed of fiber structural material, wherein the base material of at least one fiber surface fastener member to be engaged has multiple weaving or knitting structure which is one of woven or knitted in multiple layers through joining threads and has gaps between respective layers, apparent density of the base material of the other fiber surface fastener member to be engaged is 0.5 g/cm$^3$ or less, the apparent density of at least one layer including a base layer from which the engaging elements erect in said one fiber surface fastener member having the multiple weaving or knitting structure is 0.5 g/cm$^3$ or less, and the base material of the fiber surface fastener member composed of the multiple weaving or knitting structure has a knitting structure, and wale density NW (wale count/cm) and course density NC (course count/cm) in at least one knitting layer of the base material except the base layer satisfy the following equation:

$$5.9 \leq NW + NC \leq 29.0.$$

6. A product having vibration absorption means between an article having the noiseless surface fastener according to claim 5 attached thereto and the surface fastener.

7. A noiseless surface fastener made of fiber comprising a combination of surface fastener members each of which has a joining face and multiple engaging elements made of fiber at any one of a front surface and a rear surface of a flat base material composed of fiber structural material, wherein the base material of at least one fiber surface fastener member to be engaged has multiple weaving or knitting structure which is one of woven or knitted in multiple layers through joining threads and has gaps between respective layers, apparent density of the base material of the other fiber surface fastener member to be engaged is 0.5 g/cm$^9$ or less, the apparent density of at least one layer including a base layer from which the engaging elements erect in said one fiber surface fastener member have the multiple weaving or knitting structure is 0.5 g/cm$^3$ or less, and the base material composed of the multiple weaving or knitting structure has a weaving structure, and, in at least one woven layer of the base material except the base layer, warp density is 37.5 per cm or less, weft density is 18.0 per cm or less, and size of warp and weft yarns is 140 to 300 deniers.

8. A product having vibration absorption means between an article having the noiseless surface fastener according to claim 7 attached thereto and the surface fastener.

* * * * *